US011324082B2

(12) United States Patent
McCarville et al.

(10) Patent No.: US 11,324,082 B2
(45) Date of Patent: May 3, 2022

(54) RF THERMAL INCREASE SYSTEMS WITH MULTI-LEVEL ELECTRODES

(71) Applicant: NXP USA, Inc., Austin, TX (US)

(72) Inventors: Jamison Michael McCarville, Tempe, AZ (US); Lionel Mongin, Chandler, AZ (US); Pierre Marie Jean Piel, Chandler, AZ (US)

(73) Assignee: NXP USA, Inc., Austin, TX (US)

( * ) Notice: Subject to any disclaimer, the term of this patent is extended or adjusted under 35 U.S.C. 154(b) by 190 days.

(21) Appl. No.: 16/401,540

(22) Filed: May 2, 2019

(65) Prior Publication Data

US 2020/0351992 A1 Nov. 5, 2020

(51) Int. Cl.

| | |
|---|---|
| ***H05B 6/54*** | (2006.01) |
| ***H05B 1/02*** | (2006.01) |
| ***H05B 6/50*** | (2006.01) |
| ***H05B 6/62*** | (2006.01) |

(52) U.S. Cl.

CPC ..... *H05B 6/54* (2013.01); *H05B 1/0261* (2013.01); *H05B 6/50* (2013.01); *H05B 6/62* (2013.01)

(58) Field of Classification Search

CPC ... H05B 6/50; H05B 6/54; H05B 6/62; H05B 6/6402; H05B 6/6447; H05B 6/645; H05B 6/6455; H05B 6/6467; H05B 6/647; H05B 6/664; H05B 6/68; H05B 6/686; H05B 6/687; H05B 6/688; H05B 6/70; H05B 6/705; H05B 6/72; H05B 1/0261

USPC ..... 219/702, 704, 709, 745, 746, 748, 756, 219/780

See application file for complete search history.

(56) References Cited

U.S. PATENT DOCUMENTS

| | | | | |
|---|---|---|---|---|
| 4,296,299 | A * | 10/1981 | Stottmann | H05B 6/62 219/771 |
| 4,978,826 | A * | 12/1990 | DeRuiter | H05B 6/50 219/771 |
| 6,225,612 | B1 | 5/2001 | Enegren | |
| 6,784,405 | B2 | 8/2004 | Flugstad et al. | |
| 8,207,479 | B2 | 6/2012 | Ben-Shmuel et al. | |
| 8,487,222 | B2 | 7/2013 | Yamada et al. | |
| 9,215,756 | B2 | 12/2015 | Bilchinsky et al. | |
| 2001/0004075 | A1 * | 6/2001 | Wroe | H05B 6/62 219/680 |
| 2006/0081624 | A1 | 4/2006 | Takada et al. | |
| 2012/0122072 | A1 | 5/2012 | Bilchinsky et al. | |
| 2015/0351164 | A1 | 12/2015 | Wesson et al. | |
| 2018/0042073 | A1 | 2/2018 | Scott et al. | |
| 2018/0042074 | A1 | 2/2018 | Qiu et al. | |

(Continued)

FOREIGN PATENT DOCUMENTS

| | | | |
|---|---|---|---|
| CN | 101732021 | A | 6/2010 |
| CN | 108521691 | A | 9/2018 |

(Continued)

*Primary Examiner* — Hung D Nguyen
(74) *Attorney, Agent, or Firm* — Sherry Gourlay

(57) ABSTRACT

A thermal increase system includes one or more multi-level electrodes configured to radiate electromagnetic energy into a cavity in response to receiving a radio frequency (RF) signal from an RF signal source. Each multi-level electrode is positioned adjacent to a wall of the cavity, and each multi-level electrode includes a base portion coupled to an elevated portion. A radiating surface of the elevated portion is at a height of at least 0.5 centimeters (cm) from a radiating surface of the base portion.

20 Claims, 13 Drawing Sheets

(56) References Cited

U.S. PATENT DOCUMENTS

| | | | | |
|---|---|---|---|---|
| 2018/0062605 | A1* | 3/2018 | Brounley | H05B 6/46 |
| 2018/0146518 | A1 | 5/2018 | Ma et al. | |
| 2019/0191501 | A1 | 6/2019 | Piel et al. | |

FOREIGN PATENT DOCUMENTS

| | | | |
|---|---|---|---|
| CN | 108812854 | A | 11/2018 |
| EP | 3232711 | A1 | 4/2017 |

* cited by examiner

RF THERMAL INCREASE SYSTEMS WITH MULTI-LEVEL ELECTRODES

TECHNICAL FIELD

Embodiments of the subject matter described herein relate generally to apparatus and methods of heating and/or defrosting a load using radio frequency (RF) energy.

BACKGROUND

Conventional capacitive food defrosting systems include large planar electrodes contained within a heating compartment. After a food load is placed between the electrodes, low power electromagnetic energy is supplied to the electrodes to produce an electromagnetic field in the heating compartment, which gently warms the food load. Although good results may be possible using such systems, the electromagnetic field in the compartment may be uneven using conventional electrodes, which may result in uneven defrosting of the load and/or hot spots that may undesirably cook portions of the load.

BRIEF DESCRIPTION OF THE DRAWINGS

A more complete understanding of the subject matter may be derived by referring to the detailed description and claims when considered in conjunction with the following figures, wherein like reference numbers refer to similar elements throughout the figures.

DETAILED DESCRIPTION

Figure 1:
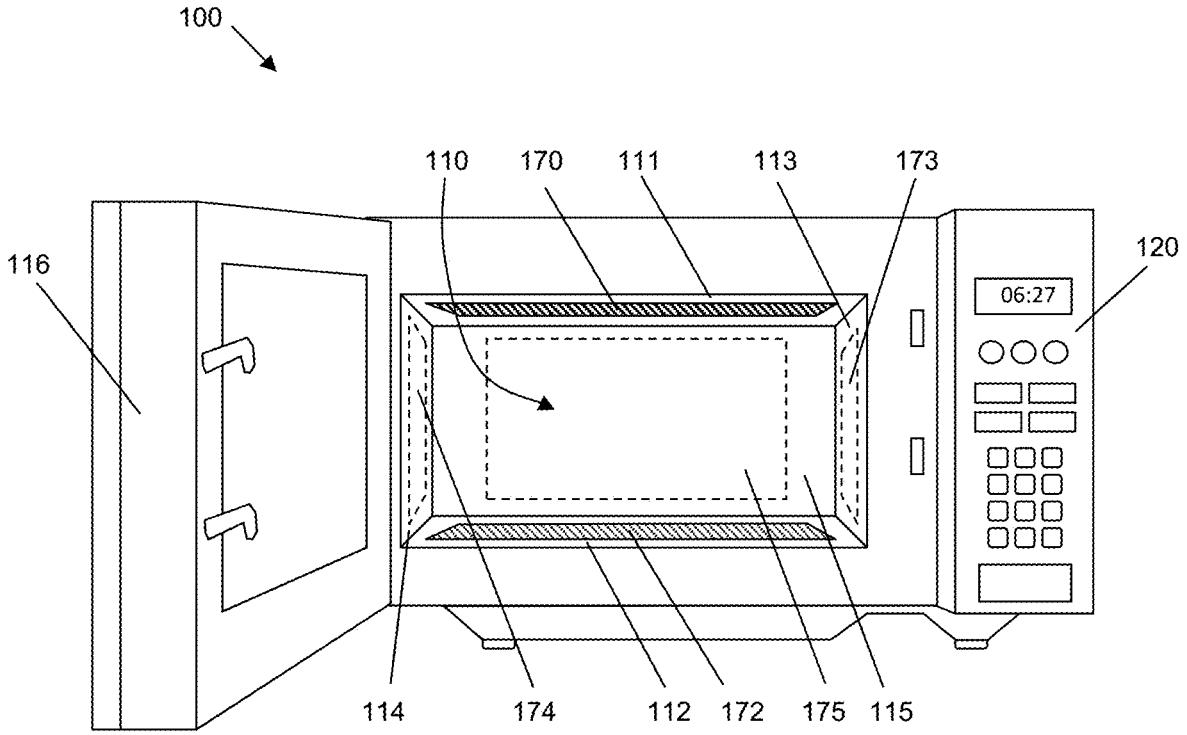
FIG. 1 is a perspective view of a defrosting appliance, in accordance with an example embodiment.

The following detailed description is merely illustrative in nature and is not intended to limit the embodiments of the subject matter or the application and uses of such embodiments. As used herein, the words "exemplary" and "example" mean "serving as an example, instance, or illustration." Any implementation described herein as exemplary or an example is not necessarily to be construed as preferred or advantageous over other implementations. Furthermore, there is no intention to be bound by any expressed or implied theory presented in the preceding technical field, background, or the following detailed description.

Embodiments of the subject matter described herein relate to solid-state thermal increase systems (e.g., defrosting and/or heating apparatus) that may be incorporated into stand-alone appliances or into other systems. As described in greater detail below, embodiments of solid-state thermal increase systems include both "unbalanced" systems and "balanced" systems. For example, exemplary "unbalanced" systems are realized using a first electrode disposed in a cavity, a single-ended amplifier arrangement (including one or more transistors) that produces a radio frequency (RF) signal, a single-ended impedance matching network coupled between an output of the amplifier arrangement and the first electrode, and a measurement and control system. In contrast, exemplary "balanced" systems are realized using first and second electrodes disposed in a cavity, a single-ended or double-ended amplifier arrangement (including one or more transistors), a double-ended impedance matching network coupled between an output of the amplifier arrangement and the first and second electrodes, and a measurement and control system. In various embodiments, the impedance matching network includes a variable impedance matching network that can be adjusted during a thermal increase operation to improve matching between the amplifier arrangement and the cavity.

The solid-state thermal increase systems embodiments described herein further include one or more "multi-level" electrodes placed on one or more sides of the cavity. In the below-described systems, these electrode embodiments may achieve a more uniform and evenly-distributed electromagnetic field in the cavity than is achievable using conventional flat electrodes. The more uniform electromagnetic field may result in more even defrosting, heating, or cooking of a load within the cavity. As will be described in more detail below, various embodiments of a multi-level electrode include one or more portions (e.g., one or more central or other portions) that are elevated (i.e., closer to the interior of the cavity) than other portion(s) (e.g., one or more peripheral or other portions) of the electrode.

Generally, the term "defrosting" means to elevate the temperature of a frozen load (e.g., a food load or other type of load) to a temperature at which the load is no longer frozen (e.g., a temperature at or near 0 degrees Celsius). As used herein, the term "defrosting" more broadly means a process by which the thermal energy or temperature of a load (e.g., a food load or other type of load) is increased through provision of RF power to the load. Accordingly, in various embodiments, a "defrosting or heating operation" may be performed on a load with any initial temperature (e.g., any initial temperature above or below 0 degrees Celsius), and the defrosting or heating operation may be ceased at any final temperature that is higher than the initial temperature (e.g., including final temperatures that are above or below 0 degrees Celsius). That said, the "defrosting or heating operations" and "defrosting systems" described herein alternatively may be referred to as "thermal increase operations" and "thermal increase systems." The term "defrosting" should not be construed to limit application of the invention to methods or systems that are only capable of raising the temperature of a frozen load to a temperature at or near 0 degrees Celsius. Instead, the various embodiments may be utilized in systems configured to raise the temperature of loads above 0 degrees Celsius, and even in systems configured to cook loads.

FIG. 1 is a perspective view of a thermal increase system 100, in accordance with an example embodiment. Thermal increase system 100 includes a cavity 110 (e.g., cavity 260, 360, FIGS. 2, 3), a control panel 120, one or more radio frequency (RF) signal sources (e.g., RF signal source 220, 320, FIGS. 2, 3), a power supply (e.g., power supply 226, 326, FIGS. 2, 3), a first electrode 170 (e.g., electrode 240, 340, FIGS. 2, 3), a second electrode 172 (e.g., electrode 350, FIG. 3), impedance matching circuitry (e.g., circuits 234, 270, 334, 372, FIGS. 2, 3), power detection circuitry (e.g., power detection circuitry 230, 330, FIGS. 2, 3), and a system controller (e.g., system controller 212, 312, FIGS. 2, 3). The cavity 110 is defined by interior surfaces of top, bottom, side, and back cavity walls 111, 112, 113, 114, 115 and an interior surface of door 116. With door 116 closed, the cavity 110 defines an enclosed air cavity. As used herein, the term "air cavity" may mean an enclosed area that contains air or other gasses (e.g., cavity 110).

According to an "unbalanced" embodiment, the first electrode 170 is arranged proximate to a cavity wall (e.g., top wall 111), the first electrode 170 is electrically isolated from the remaining cavity walls (e.g., walls 112-115 and door 116), and the remaining cavity walls may be grounded. In such a configuration, the system may be simplistically modeled as a capacitor, where the first electrode 170 functions as one conductive plate (or electrode), the grounded cavity walls (e.g., walls 112-115) function as a second conductive plate (or electrode), and the air cavity (including any load contained therein) function as a dielectric medium between the first and second conductive plates. Although not shown in FIG. 1, a non-electrically conductive barrier (e.g., barrier 262, 356, FIGS. 2, 3) also may be included in the system 100, and the non-conductive barrier may function to electrically and physically isolate the load from the bottom cavity wall 112. Although FIG. 1 shows the first electrode 170 being proximate to the top wall 111, the first electrode 170 alternatively may be proximate to any of the other walls 112-115, as indicated by electrode positions 172-175.

According to a "balanced" embodiment, the first electrode 170 is arranged proximate to a first cavity wall (e.g., top wall 111), a second electrode 172 is arranged proximate to an opposite, second cavity wall (e.g., bottom wall 112), and the first and second electrodes 170, 172 are electrically isolated from the remaining cavity walls (e.g., walls 113-115 and door 116). In such a configuration, the system also may be simplistically modeled as a capacitor, where the first electrode 170 functions as one conductive plate (or electrode), the second electrode 172 functions as a second conductive plate (or electrode), and the air cavity (including any load contained therein) function as a dielectric medium between the first and second conductive plates. Although not shown in FIG. 1, a non-electrically conductive barrier (e.g., barrier 314, FIG. 3) also may be included in the system 100, and the non-conductive barrier may function to electrically and physically isolate the load from the second electrode 172 and the bottom cavity wall 112. Although FIG. 1 shows the first electrode 170 being proximate to the top wall 111, and the second electrode 172 being proximate to the bottom wall 112, the first and second electrodes 170, 172 alternatively may be proximate to other opposite walls (e.g., the first electrode may be electrode 173 proximate to wall 113, and the second electrode may be electrode 174 proximate to wall 114. As will be illustrated and explained in more detail in conjunction with FIGS. 2-16, either or both the first electrode 170 and/or the second electrode 172 may be a multi-level electrode with one or more portions that extend further into the cavity 110 than other portions of the electrode 170, 172. Further, either or both the first electrode 170 and/or the second electrode 172 may be nested within a dielectric support (e.g., dielectric support 246, 346, 356, 800, 1580, 1780, FIGS. 2, 3, 8-12, 17, 19), to establish a substantially planar, cavity-facing surface.

According to an embodiment, during operation of the thermal increase system 100, a user (not illustrated) may place one or more loads (e.g., food and/or liquids) into the cavity 110, and optionally may provide inputs via the control panel 120 that specify characteristics of the load(s). For example, the specified characteristics may include an approximate weight of the load. In addition, the specified load characteristics may indicate the material(s) from which the load is formed (e.g., meat, bread, liquid). In alternate embodiments, the load characteristics may be obtained in some other way, such as by scanning a barcode on the load packaging or receiving a radio frequency identification (RFID) signal from an RFID tag on or embedded within the load. Either way, as will be described in more detail later, information regarding such load characteristics enables the system controller (e.g., system controller 212, 312, FIGS. 2, 3) to establish an initial state for an impedance matching network of the system at the beginning of the thermal increase operation, where the initial state may be relatively close to an optimal state that enables maximum RF power transfer into the load. Alternatively, load characteristics may not be entered or received prior to commencement of a thermal increase operation, and the system controller may establish a default initial state for the impedance matching network.

To begin the thermal increase operation, the user may provide an input via the control panel 120. In response, the system controller causes the RF signal source(s) (e.g., RF signal source 220, 320, FIGS. 2, 3) to supply an RF signal to the first electrode 170 in an unbalanced embodiment, or to both the first and second electrodes 170, 172 in a balanced embodiment, and the electrode(s) responsively radiate electromagnetic energy into the cavity 110. The electromagnetic energy increases the thermal energy of the load (i.e., the electromagnetic energy causes the load temperature to increase).

During the thermal increase operation, the impedance of the load (and thus the total input impedance of the cavity 110 plus load) changes as the thermal energy of the load increases. The impedance changes alter the absorption of RF energy into the load, and thus alter the magnitude of reflected power. According to an embodiment, power detection circuitry (e.g., power detection circuitry 230, 330, FIGS. 2, 3) continuously or periodically measures the reflected power along a transmission path (e.g., transmission path 228, 328, FIGS. 2, 3) between the RF signal source (e.g., RF signal source 220, 320, FIGS. 2, 3) and the electrode(s) 170, 172. Based on these measurements, the system controller (e.g., system controller 212, 312, FIGS. 2, 3) may alter operations of the system 100 (e.g., adjusting power levels and frequencies of the RF signal produced by the RF signal source, discontinuing operation, and so on), and/or may detect completion of the thermal increase operation. According to a further embodiment, the impedance matching network is variable, and based on the reflected power measurements (or both the forward and reflected power measurements), the system controller may alter the state of the impedance matching network during the thermal increase operation to increase the absorption of RF power by the load.

The thermal increase system 100 of FIG. 1 is embodied as a counter-top type of appliance. In a further embodiment, the thermal increase system 100 also may include components and functionality for performing microwave cooking operations. Alternatively, components of a thermal increase system may be incorporated into other types of systems or appliances. For example, components of a thermal increase system may be incorporated into a refrigerator/freezer type of appliance. For example, a thermal increase system may be incorporated within a main interior compartment of a refrigerator or freezer, and access to the interior cavity (e.g., cavity 110) may be provided through a door (e.g., door 116). Alternatively, the interior cavity (e.g., cavity 110) may be implemented as a drawer, where a bottom electrode may be incorporated in the bottom of the drawer, and a top electrode may be incorporated in a shelf under which the drawer slides. In still other embodiments, components of a thermal increase system may be incorporated into a built-in oven type of appliance, or other stand-alone, built-in, or combination types of appliances.

Although thermal increase system 100 is shown with its components in particular relative orientations with respect to one another, it should be understood that the various components may be oriented differently, as well. In addition, the physical configurations of the various components may be different. For example, control panel 120 may have more, fewer, or different user interface elements, and/or the user interface elements may be differently arranged. In addition, although a substantially cubic cavity 110 is illustrated in FIG. 1, it should be understood that a cavity may have a different shape, in other embodiments (e.g., cylindrical, and so on). Further, thermal increase system 100 may include additional components (e.g., a fan, a stationary or rotating plate, a tray, an electrical cord, and so on) that are not specifically depicted in FIG. 1.

Figure 2:
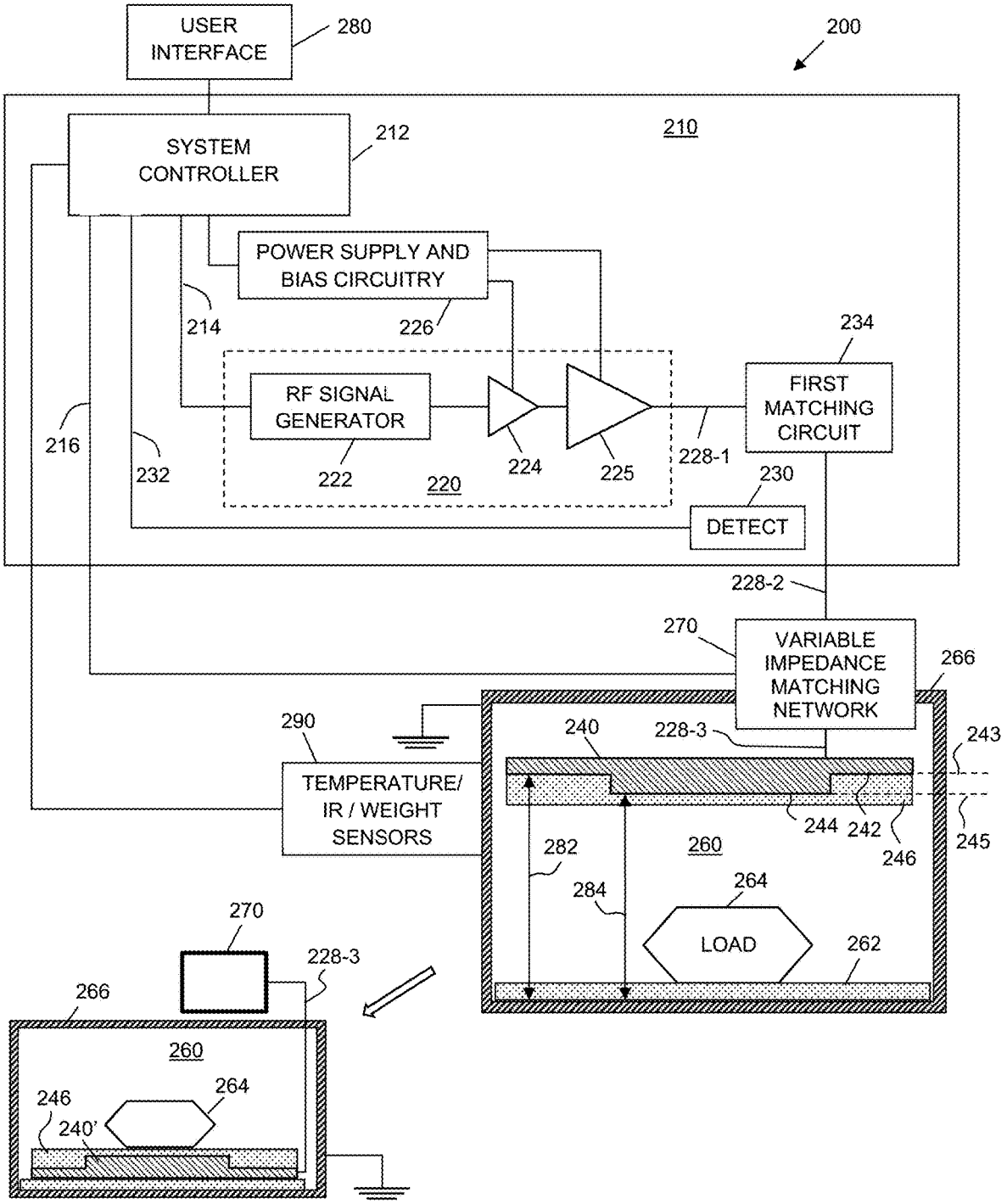
FIG. 2 is a simplified block diagram of an unbalanced defrosting apparatus, in accordance with an example embodiment.

FIG. 2 is a simplified block diagram of an unbalanced thermal increase system 200 (e.g., thermal increase system 100, FIG. 1), in accordance with an example embodiment. Thermal increase system 200 includes RF subsystem 210, cavity 260, user interface 280, system controller 212, RF signal source 220, power supply and bias circuitry 226, variable impedance matching network 270, electrode 240 (or 240'), containment structure 266, and power detection circuitry 230, in an embodiment. In addition, in other embodiments, thermal increase system 200 may include temperature sensor(s), infrared (IR) sensor(s), and/or weight sensor(s) 290, although some or all of these sensor components may be excluded. It should be understood that FIG. 2 is a simplified representation of a thermal increase system 200 for purposes of explanation and ease of description, and that practical embodiments may include other devices and components to provide additional functions and features, and/or the thermal increase system 200 may be part of a larger electrical system.

User interface 280 may correspond to a control panel (e.g., control panel 120, FIG. 1), for example, which enables a user to provide inputs to the system regarding parameters for a defrosting or heating operation (e.g., characteristics of the load to be defrosted or heated, and so on), start and cancel buttons, mechanical controls (e.g., a door/drawer open latch), and so on. In addition, the user interface may be configured to provide user-perceptible outputs indicating the status of a thermal increase operation (e.g., a countdown timer, visible indicia indicating progress or completion of the thermal increase operation, and/or audible tones indicating completion of the thermal increase operation) and other information.

Some embodiments of thermal increase system 200 may include temperature sensor(s), IR sensor(s), and/or weight sensor(s) 290. The temperature sensor(s) and/or IR sensor(s) may be positioned in locations that enable the temperature of the load 264 to be sensed during the defrosting or heating operation. When provided to the system controller 212, the temperature information enables the system controller 212 to alter the power of the RF signal supplied by the RF signal source 220 (e.g., by controlling the bias and/or supply voltages provided by the power supply and bias circuitry 226), to adjust the state of the variable impedance matching network 270, and/or to determine when the defrosting or heating operation should be terminated. The weight sensor(s) are positioned under the load 264, and are configured to provide an estimate of the weight of the load 264 to the system controller 212. The system controller 212 may use this information, for example, to determine a desired power level for the RF signal supplied by the RF signal source 220, to determine an initial setting for the variable impedance matching network 270, and/or to determine an approximate duration for the defrosting or heating operation.

The RF subsystem 210 includes a system controller 212, an RF signal source 220, first impedance matching circuit 234 (herein "first matching circuit"), power supply and bias circuitry 226, and power detection circuitry 230, in an embodiment. System controller 212 may include one or more general purpose or special purpose processors (e.g., a microprocessor, microcontroller, Application Specific Integrated Circuit (ASIC), and so on), volatile and/or non-volatile memory (e.g., Random Access Memory (RAM), Read Only Memory (ROM), flash, various registers, and so on), one or more communication busses, and other components. According to an embodiment, system controller 212 is coupled to user interface 280, RF signal source 220, variable impedance matching network 270, power detection circuitry 230, and sensors 290 (if included). System controller 212 is configured to receive signals indicating user inputs received via user interface 280, and to receive signals indicating RF signal reflected power (and possibly RF signal forward power) from power detection circuitry 230. Responsive to the received signals and measurements, system controller 212 provides control signals to the power supply and bias circuitry 226 and to the RF signal generator 222 of the RF signal source 220. In addition, system controller 212 provides control signals to the variable impedance matching network 270, which cause the network 270 to change its state or configuration.

Cavity 260 includes a capacitive defrosting arrangement with first and second parallel plate electrodes that are separated by an air cavity within which a load 264 to be defrosted or heated may be placed. For example, in one embodiment, a first electrode 240 may be positioned above the air cavity, and a second electrode may be provided by a portion of a containment structure 266. In another embodiment, as shown in the lower left corner of FIG. 2, a first electrode 240' may be positioned below the air cavity, and a second electrode may be provided by a portion of a containment structure 266. More specifically, the containment structure 266 may include bottom, top, and side walls, the interior surfaces of which define the cavity 260 (e.g., cavity 110, FIG. 1). According to an embodiment, the cavity 260 may be sealed (e.g., with a door 116, FIG. 1 or through the action of sliding closed a drawer) to contain the electromagnetic energy that is introduced into the cavity 260 during a defrosting or heating operation. The system 200 may include one or more interlock mechanisms that ensure that the seal is intact during a defrosting or heating operation. If one or more of the interlock mechanisms indicates that the seal is breached, the system controller 212 may cease the defrosting or heating operation. According to an embodiment, the containment structure 266 is at least partially formed from conductive material, and the conductive portion(s) of the containment structure may be grounded. Alternatively, at least the portion of the containment structure 266 that corresponds to the bottom surface of the cavity 260 may be formed from conductive material and grounded. Either way, the containment structure 266 (or at least the portion of the containment structure 266 that is parallel with the first electrode 240) functions as a second electrode of the capacitive defrosting arrangement. To avoid direct contact between the load 264 and the grounded bottom surface of the cavity 260, a non-conductive barrier 262 may be positioned over the bottom surface of the cavity 260.

Essentially, cavity 260 includes a capacitive defrosting arrangement with first and second electrodes 240 (or 240'), 266 that are separated by an air cavity within which a load 264 to be defrosted may be placed. According to various embodiments, the first electrode 240 (or 240') is assembled within system 200 adjacent to a first wall (e.g., wall 170 or 172, FIG. 1), where "adjacent to" in the context of the proximity of an electrode to a cavity wall means that at least some of the radiating surfaces of the electrode are co-planar with the cavity wall, or at least some of the radiating surfaces of the electrode are in parallel planes with the cavity wall (e.g., parallel planes within 0 to 5 centimeters (or more) of the cavity wall). The first electrode 240 (or 240') is a multi-level electrode (e.g., any of electrode embodiments 400, 600, 1300, 1400, 1500, 1700, FIGS. 4-7, 13-18 or variants thereof) which has one or more first portions 242 and one or more second portions 244, where the first and second portions 242, 244 include radiating surfaces that are at different heights (i.e., coplanar with different planes and/or coplanar with different parallel planes). More specifically, when the first electrode 240 (or 240') is assembled within system 200, the first portion(s) 242 may include one or more planar conductive regions (or portions of radiating surfaces) that are co-planar with a first plane 243 that is located a first distance 282 from an opposed surface of the containment structure 266 (e.g., the bottom or top surface), or at a first distance from an opposed electrode, or at a first distance from an opposed cavity wall, and the second portion(s) 244 may include one or more planar conductive regions (or portions of radiating surfaces) that are co-planar with a second plane 245 that is located a second distance 284 from the opposed surface of the containment structure 266, or from an opposed electrode, or from an opposed cavity wall, where the first distance 282 is greater than the second distance 284. In other words, the second portion(s) 244 are positioned closer to the opposed surface of the containment structure 266 or an opposed electrode than the first portion(s) 242. Accordingly, the second portions(s) 244 are located closer to a center of the cavity 260 than the first portion(s) 242. In various embodiments, the second portions 244 are generally located toward a center of the electrode 240, 240' (or a central, vertical axis through the cavity 260), and the first portions 242 are generally located toward a periphery of the electrode 240, 240'.

In some embodiments, the first electrode 240 (or 240') may be coupled with (e.g., nested into) a dielectric support 246 (e.g., dielectric support 800, 1580, 1780, FIGS. 8-12, 16, 18). As will be explained in more detail in conjunction with FIGS. 8-12, 16, and 18, dielectric support 246 may include a contoured inner cavity configured to receive the first electrode 240 (or 240'), and a substantially planar outer surface (e.g., the surface that faces cavity 260).

In various embodiments, the distances 282, 284 between the opposed surface of the containment structure 266 and the first electrode 240 (or 240') are in a range of about 0.10 meters to about 1.0 meter, although the distances may be smaller or larger, as well. According to an embodiment, distances 282, 284 are less than one wavelength of the RF signal produced by the RF subsystem 210. In other words, the cavity 260 is a sub-resonant cavity during operation of system 200. In some embodiments, the distances 282, 284 are less than about half of one wavelength of the RF signal. In other embodiments, the distances 282, 284 are less than about one quarter of one wavelength of the RF signal. In still other embodiments, the distances 282, 284 are less than about one eighth of one wavelength of the RF signal. In still other embodiments, the distances 282, 284 are less than about one 50th of one wavelength of the RF signal. In still other embodiments, the distances 282, 284 are less than about one 100th of one wavelength of the RF signal.

In general, a system 200 designed for lower operational frequencies (e.g., frequencies between 10 megahertz (MHz) and 100 MHz) may be designed to have distances 282, 284 that are a smaller fraction of one wavelength. For example, when system 200 is designed to produce an RF signal with an operational frequency of about 10 MHz (corresponding to a wavelength of about 20 meters), and distances 282, 284 are selected to be about 0.5 meters, the distances 282, 284 are about one 60th of one wavelength of the RF signal. Conversely, when system 200 is designed for an operational frequency of about 200 MHz (corresponding to a wavelength of about 1 meter), and distances 282, 284 are selected to be about 0.5 meters, the distances 282, 284 are about one half of one wavelength of the RF signal.

With the operational frequency and the distances 282, 284 between electrode 240 (or 240') and an opposed surface of containment structure 266 being selected to define a sub-resonant interior cavity 260, the first electrode 240 (or 240') and the containment structure 266 are capacitively coupled. More specifically, the first electrode 240 (or 240') may be analogized to a first plate of a capacitor, the containment structure 266 may be analogized to a second plate of a capacitor, and the load 264, dielectric support 246, barrier 262, and air within the cavity 260 may be analogized to a capacitor dielectric. Accordingly, the first electrode 240 (or 240') alternatively may be referred to herein as an "anode," and the containment structure 266 may alternatively be referred to herein as a "cathode."

Essentially, the voltage across the first electrode 240 (or 240') and the containment structure 266 (or the electromagnetic field between the electrode 240 and the containment structure) heats the load 264 within the cavity 260. According to various embodiments, the RF subsystem 210 is configured to generate the RF signal to produce voltages between the electrode 240 (or 240') and the containment structure 266 in a range of about 90 volts to about 3,000 volts, in one embodiment, or in a range of about 3000 volts to about 10,000 volts, in another embodiment, although the system may be configured to produce lower or higher voltages between the electrode 240 (or 240') and the containment structure 266, as well.

The first electrode 240 (or 240') is electrically coupled to the RF signal source 220 through a first matching circuit 234, a variable impedance matching network 270, and a conductive transmission path, in an embodiment. The first matching circuit 234 is configured to perform an impedance transformation from an impedance of the RF signal source 220 (e.g., less than about 10 ohms) to an intermediate impedance (e.g., 50 ohms, 75 ohms, or some other value). As will be described in more detail later, the variable impedance matching circuit 270 is configured to perform an impedance transformation from the above-mentioned intermediate impedance to an input impedance of cavity 220 as modified by the load 264 (e.g., on the order of hundreds or thousands of ohms, such as about 1000 ohms to about 4000 ohms or more). In an embodiment, the variable impedance matching network 270 includes a network of passive components (e.g., inductors, capacitors, resistors).

Figure 3:
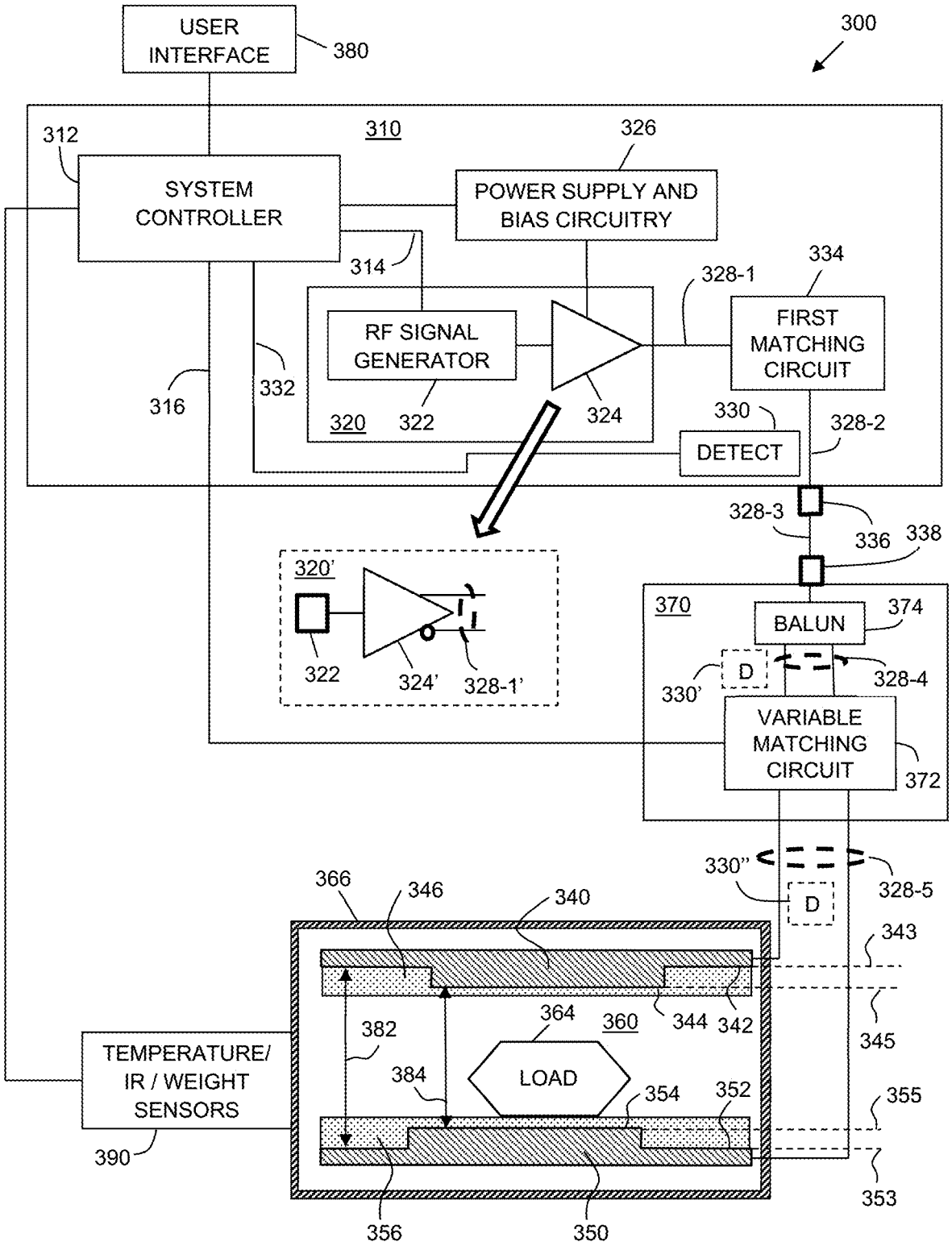
FIG. 3 is a simplified block diagram of a balanced defrosting apparatus, in accordance with another example embodiment.

According to an embodiment, the conductive transmission path includes a plurality of conductors 228-1, 228-2, and 228-3 connected in series, and referred to collectively as transmission path 228. According to an embodiment, the conductive transmission path 228 is an "unbalanced" path, which is configured to carry an unbalanced RF signal (i.e., a single RF signal referenced against ground). In some embodiments, one or more connectors (not shown, but each having male and female connector portions) may be electrically coupled along the transmission path 228, and the portion of the transmission path 228 between the connectors may comprise a coaxial cable or other suitable connector. Such a connection is shown in FIG. 3 and described later (e.g., including connectors 336, 338 and a conductor 328-3 such as a coaxial cable between the connectors 336, 338).

According to an embodiment, RF signal source 226 includes an RF signal generator 222 and a power amplifier (e.g., including one or more power amplifier stages 224, 225). In response to control signals provided by system controller 212 over connection 214, RF signal generator 222 is configured to produce an oscillating electrical signal having a frequency in the ISM (industrial, scientific, and medical) band, although the system could be modified to support operations in other frequency bands, as well. The RF signal generator 222 may be controlled to produce oscillating signals of different power levels and/or different frequencies, in various embodiments. For example, the RF signal generator 222 may produce a signal that oscillates in a range of about 10.0 MHz to about 100 MHz and/or from about 100 MHz to about 2.0 gigahertz (GHz). Some desirable frequencies may be, for example, 13.56 MHz (+/−5 percent), 27.125 MHz (+/−5 percent), 40.68 MHz (+/−5 percent), and 2.45 GHz (+/−5 percent). In one particular embodiment, for example, the RF signal generator 222 may produce a signal that oscillates in a range of about 40.66 MHz to about 40.70 MHz and at a power level in a range of about 10 decibel-milliwatts (dBm) to about 15 dBm. Alternatively, the frequency of oscillation and/or the power level may be lower or higher.

In the embodiment of FIG. 2, the power amplifier includes a driver amplifier stage 224 and a final amplifier stage 225. The power amplifier is configured to receive the oscillating signal from the RF signal generator 222, and to amplify the signal to produce a significantly higher-power signal at an output of the power amplifier. For example, the output signal may have a power level in a range of about 100 watts to about 400 watts or more. The gain applied by the power amplifier may be controlled using gate bias voltages and/or drain supply voltages provided by the power supply and bias circuitry 226 to each amplifier stage 224, 225. More specifically, power supply and bias circuitry 226 provides bias and supply voltages to each RF amplifier stage 224, 225 in accordance with control signals received from system controller 212.

In an embodiment, each amplifier stage 224, 225 is implemented as a power transistor, such as a field effect transistor (FET), having an input terminal (e.g., a gate or control terminal) and two current carrying terminals (e.g., source and drain terminals). Impedance matching circuits (not illustrated) may be coupled to the input (e.g., gate) of the driver amplifier stage 224, between the driver and final amplifier stages 225, and/or to the output (e.g., drain terminal) of the final amplifier stage 225, in various embodiments. In an embodiment, each transistor of the amplifier stages 224, 225 includes a laterally diffused metal oxide semiconductor FET (LDMOSFET) transistor. However, it should be noted that the transistors are not intended to be limited to any particular semiconductor technology, and in other embodiments, each transistor may be realized as a gallium nitride (GaN) transistor, another type of MOSFET transistor, a bipolar junction transistor (BJT), or a transistor utilizing another semiconductor technology.

In FIG. 2, the power amplifier arrangement is depicted to include two amplifier stages 224, 225 coupled in a particular manner to other circuit components. In other embodiments, the power amplifier arrangement may include other amplifier topologies and/or the amplifier arrangement may include only one amplifier stage (e.g., as shown in the embodiment of amplifier 324, FIG. 3), or more than two amplifier stages. For example, the power amplifier arrangement may include various embodiments of a single-ended amplifier, a Doherty amplifier, a Switch Mode Power Amplifier (SMPA), or another type of amplifier.

Cavity 260 and any load 264 (e.g., food, liquids, and so on) positioned in the cavity 260 present a cumulative load for the electromagnetic energy (or RF power) that is radiated into the cavity 260 by the first electrode 240 (or 240'). More specifically, the cavity 260 and the load 264 present an impedance to the system, referred to herein as a "cavity input impedance." The cavity input impedance changes during a defrosting or heating operation as the temperature of the load 264 increases. The cavity input impedance has a direct effect on the magnitude of reflected signal power along the conductive transmission path 228 between the RF signal source 220 and electrode 240 (or 240'). In most cases, it is desirable to maximize the magnitude of transferred signal power into the cavity 260, and/or to minimize the reflected-to-forward signal power ratio along the conductive transmission path 228.

In order to at least partially match the output impedance of the RF signal generator 220 to the chamber input impedance, a first matching circuit 234 is electrically coupled along the transmission path 228, in an embodiment. The first matching circuit 234 may have any of a variety of configurations. According to an embodiment, the first matching circuit 234 includes fixed components (i.e., components with non-variable component values), although the first matching circuit 234 may include one or more variable components, in other embodiments. For example, the first matching circuit 234 may include any one or more circuits selected from an inductance/capacitance (LC) network, a series inductance network, a shunt inductance network, or a combination of bandpass, high-pass and low-pass circuits, in various embodiments. Essentially, the fixed matching circuit 234 is configured to raise the impedance to an intermediate level between the output impedance of the RF signal generator 220 and the chamber input impedance.

According to an embodiment, power detection circuitry 230 is coupled along the transmission path 228 between the output of the RF signal source 220 and the electrode 240 (or 240'). In a specific embodiment, the power detection circuitry 230 forms a portion of the RF subsystem 210, and is coupled to the conductor 228-2 between the output of the first matching circuit 234 and the input to the variable impedance matching network 270, in an embodiment. In alternate embodiments, the power detection circuitry 230 may be coupled to the portion 228-1 of the transmission path 228 between the output of the RF signal source 220 and the input to the first matching circuit 234, or to the portion 228-3 of the transmission path 228 between the output of the variable impedance matching network 270 and the first electrode 240 (or 240').

Wherever it is coupled, power detection circuitry 230 is configured to monitor, measure, or otherwise detect the power of the reflected signals traveling along the transmission path 228 between the RF signal source 220 and electrode 240 (or 240') (i.e., reflected RF signals traveling in a direction from electrode 240 (or 240') toward RF signal source 220). In some embodiments, power detection circuitry 230 also is configured to detect the power of the forward signals traveling along the transmission path 228 between the RF signal source 220 and the electrode 240 (or 240') (i.e., forward RF signals traveling in a direction from RF signal source 220 toward electrode 240, 240'). Over connection 232, power detection circuitry 230 supplies signals to system controller 212 conveying the magnitudes of the reflected signal power (and the forward signal power, in some embodiments) to system controller 212. In embodiments in which both the forward and reflected signal power magnitudes are conveyed, system controller 212 may calculate a reflected-to-forward signal power ratio, or the S11 parameter. When the reflected signal power magnitude exceeds a reflected signal power threshold, or when the reflected-to-forward signal power ratio exceeds an S11 parameter threshold, this indicates that the system 200 is not adequately matched to the cavity input impedance, and that energy absorption by the load 264 within the cavity 260 may be sub-optimal. In such a situation, system controller 212 may orchestrate a process of altering the state of the variable matching network 270 to drive the reflected signal power or the S11 parameter toward or below a desired level (e.g., below the reflected signal power threshold and/or the reflected-to-forward signal power ratio threshold), thus re-establishing an acceptable match and facilitating more optimal energy absorption by the load 264.

More specifically, the system controller 212 may provide control signals over control path 216 to the variable matching circuit 270, which cause the variable matching circuit 270 to vary inductive, capacitive, and/or resistive values of one or more components within the circuit, thus adjusting the impedance transformation provided by the circuit 270. Adjustment of the configuration of the variable matching circuit 270 desirably decreases the magnitude of reflected signal power, which corresponds to decreasing the magnitude of the S11 parameter and increasing the power absorbed by the load 264.

According to a specific embodiment, the variable impedance matching network 270 includes a plurality of fixed-value lumped inductors that are positioned within or proximate to the cavity 260 and which are electrically coupled to the first electrode 240 (or 240'). In addition, the variable impedance matching network 270 includes a plurality of variable inductance networks, which may be located inside or outside of the cavity 260. According to another specific embodiment, the variable impedance matching network 270 includes a plurality of variable capacitance networks, which may be located inside or outside of the cavity 260. The inductance or capacitance value provided by each of the variable inductance or capacitance networks is established using control signals from the system controller 212. In any event, by changing the state of the variable impedance matching network 270 over the course of a defrosting or heating operation to dynamically match the ever-changing cavity input impedance, the amount of RF power that is absorbed by the load 264 may be maintained at a high level despite variations in the load impedance during the defrosting or heating operation.

The variable matching network 270 may have any of a variety of configurations. For example, the network 270 may include any one or more circuits selected from an LC network, an inductance-only network, a capacitance-only network, or a combination of bandpass, high-pass and low-pass circuits, in various embodiments. In an embodiment, the variable matching network 270 includes a single-ended network. The inductance, capacitance, and/or resistance values provided by the variable matching network 270, which in turn affect the impedance transformation provided by the network 270, are established using control signals from the system controller 212. In any event, by changing the state of the variable matching network 270 over the course of a defrosting or heating operation to dynamically match the ever-changing impedance of the cavity 260 plus the load 264 within the cavity 260, the system efficiency may be maintained at a high level throughout the defrosting or heating operation.

As discussed above, the variable impedance matching network 270 is used to match the input impedance of the cavity 260 plus load 264 to maximize, to the extent possible, the RF power transfer into the load 264. The initial impedance of the cavity 260 and the load 264 may not be known with accuracy at the beginning of a defrosting or heating operation. Further, the impedance of the load 264 changes during a defrosting or heating operation as the load 264 warms up. According to an embodiment, the system controller 212 may provide control signals to the variable impedance matching network 270, which cause modifications to the state of the variable impedance matching network 270. This enables the system controller 212 to establish an initial state of the variable impedance matching network 270 at the beginning of the defrosting or heating operation that has a relatively low reflected to forward power ratio, and thus a relatively high absorption of the RF power by the load 264. In addition, this enables the system controller 212 to modify the state of the variable impedance matching network 270 so that an adequate match may be maintained throughout the defrosting or heating operation, despite changes in the impedance of the load 264.

The description associated with FIG. 2 discusses, in detail, an "unbalanced" defrosting apparatus, in which an RF signal is applied to one electrode (e.g., electrode 240, 240', FIG. 2), and the other "electrode" (e.g., the containment structure 266, FIG. 2) is grounded. As indicated above, an alternate embodiment of a defrosting apparatus comprises a "balanced" defrosting apparatus. In such an apparatus, balanced RF signals are provided to both electrodes.

For example, FIG. 3 is a simplified block diagram of a balanced thermal increase system 300 (e.g., thermal increase system 100, FIG. 1), in accordance with an example embodiment. Thermal increase system 300 includes RF subsystem 310, cavity 360, user interface 380, system controller 312, RF signal source 320, power supply and bias circuitry 326, variable impedance matching network 370, two electrodes 340, 350, and power detection circuitry 330, in an embodiment. In addition, in other embodiments, thermal increase system 300 may include temperature sensor(s), infrared (IR)

sensor(s), and/or weight sensor(s) 390, although some or all of these sensor components may be excluded. It should be understood that FIG. 3 is a simplified representation of a thermal increase system 300 for purposes of explanation and ease of description, and that practical embodiments may include other devices and components to provide additional functions and features, and/or the thermal increase system 300 may be part of a larger electrical system.

User interface 380 may correspond to a control panel (e.g., control panel 120, FIG. 1), for example, which enables a user to provide inputs to the system regarding parameters for a defrosting or heating operation (e.g., characteristics of the load to be defrosted, and so on), start and cancel buttons, mechanical controls (e.g., a door/drawer open latch), and so on. In addition, the user interface may be configured to provide user-perceptible outputs indicating the status of a defrosting or heating operation (e.g., a countdown timer, visible indicia indicating progress or completion of the defrosting or heating operation, and/or audible tones indicating completion of the defrosting or heating operation) and other information.

The RF subsystem 310 includes a system controller 312, an RF signal source 320 (or 320'), a first impedance matching circuit 334 (herein "first matching circuit"), power supply and bias circuitry 326, and power detection circuitry 330, in an embodiment. System controller 312 may include one or more general purpose or special purpose processors (e.g., a microprocessor, microcontroller, ASIC, and so on), volatile and/or non-volatile memory (e.g., RAM, ROM, flash, various registers, and so on), one or more communication busses, and other components. According to an embodiment, system controller 312 is operatively and communicatively coupled to user interface 380, RF signal source 320 (or 320'), power supply and bias circuitry 326, power detection circuitry 330 (or 330' or 330"), variable matching subsystem 370, and sensor(s) 390 (if included). System controller 312 is configured to receive signals indicating user inputs received via user interface 380, to receive signals indicating RF signal reflected power (and possibly RF signal forward power) from power detection circuitry 330 (or 330' or 330"), and to receive sensor signals from sensor(s) 390. Responsive to the received signals and measurements, system controller 312 provides control signals to the power supply and bias circuitry 326 and/or to the RF signal generator 322 of the RF signal source 320. In addition, system controller 312 provides control signals to the variable matching subsystem 370 (over path 316), which cause the subsystem 370 to change the state or configuration of a variable impedance matching circuit 372 of the subsystem 370.

Cavity 360 includes a capacitive defrosting arrangement with first and second electrodes 340, 350 that are separated by an air cavity within which a load 364 to be defrosted may be placed. Within a containment structure 366, first and second electrodes 340, 350 (e.g., electrodes 140, 150, FIG. 1) are positioned in a fixed physical relationship with respect to each other on either side of an interior cavity 360 (e.g., cavity 110, FIG. 1).

According to an embodiment, the first electrode 340 is assembled within system 300 adjacent to a first wall (e.g., wall 170, FIG. 1), and the second electrode 350 is assembled within system 300 adjacent to a second wall (e.g., wall 172, FIG. 1) that is opposite the first wall. Both the first electrode 340 and the second electrode 350 are multi-level electrodes (e.g., each corresponding to any of electrode embodiments 400, 600, 700, 1300, 1400, 1500, 1700, FIGS. 4-7, 10-18 or variants thereof). In one alternate embodiment, only the first electrode 340 is a multi-level electrode, and the second electrode 350 is a single-level, planar electrode (e.g., an electrode that is substantially flat across an entirety of its cavity-facing surface). In another alternate embodiment, only the second electrode 350 is a multi-level electrode, and the first electrode 340 is a single-level, planar electrode.

In an embodiment in which both electrodes 340, 350 are multi-level electrodes, each electrode 340, 350 has one or more first portions 342, 352 and one or more second portions 344, 354, where the first and second portions 342, 344, 352, 354 include radiating surfaces that are at different heights. More specifically, when the first electrode 340 is assembled within system 300 adjacent to a first wall (e.g., wall 170, FIG. 1), the first portion(s) 342 may include one or more planar conductive regions (or portions of radiating surfaces) that are co-planar with a first plane 343 that is located a first distance 382 from the second electrode 350 (or a first distance from a second, opposite wall, such as wall 172, FIG. 1), and the second portion(s) 344 may include one or more planar conductive regions (or portions of radiating surfaces) that are co-planar with a second plane 345 that is located a second distance 384 from the second electrode 350 (or a second distance from the second wall), where the first distance 382 is greater than the second distance 384. On the flip side, when the second electrode 350 is assembled within system 300 adjacent to a second wall (e.g., wall 172, FIG. 1), the first portion(s) 352 may include one or more planar conductive regions (or portions of radiating surfaces) that are co-planar with a first plane 353 that is located the first distance 382 from the first electrode 340 (or a first distance from the first wall), and the second portion(s) 354 may include one or more planar conductive regions (or portions of radiating surfaces) that are co-planar with a second plane 355 that is located the second distance 384 from the first electrode 340 (or a second distance from the first wall). In other words, the second portion(s) 344, 354 are positioned closer to the opposed electrode than the first portion(s) 342, 352. Accordingly, the second portions(s) 344, 354 are located closer to a center of the cavity 360 than the first portion(s) 342, 352. In various embodiments, the second portions 344, 354 are generally located toward a center of each electrode 340, 350 (or a central, vertical axis through the cavity 360), and the first portions 342, 352 are generally located toward a periphery of each electrode 340, 350.

In some embodiments, each of the first electrode 340 and the second electrode 350 may be coupled with (e.g., nested into) a dielectric support 346, 356 (e.g., dielectric support 800, 1580, 1780, FIGS. 8-12, 16, 18). As will be explained in more detail in conjunction with FIGS. 8-12, 16, and 18, each dielectric support 346, 356 may include a contoured inner cavity configured to receive the first or second electrode 340, 350, and a substantially planar outer surface (e.g., the surface that faces cavity 360). This is particularly advantageous for the second electrode 350, in that the dielectric support 356 renders the bottom surface of the cavity 360 flat, which facilitates physical stability of the load 364.

In various embodiments, the distances 382, 384 are in a range of about 0.10 meters to about 1.0 meter, although the distances may be smaller or larger, as well. According to an embodiment, distances 382, 384 are less than one wavelength of the RF signal produced by the RF subsystem 310. In other words, the cavity 360 is a sub-resonant cavity. In some embodiments, the distances 382, 384 are less than about half of one wavelength of the RF signal. In other embodiments, the distances 382, 384 are less than about one quarter of one wavelength of the RF signal. In still other embodiments, the distances 382, 384 are less than about one eighth of one wavelength of the RF signal. In still other embodiments, the distances 382, 384 are less than about one 50th of one wavelength of the RF signal. In still other embodiments, the distances 382, 384 are less than about one 100th of one wavelength of the RF signal.

In general, a system 300 designed for lower operational frequencies (e.g., frequencies between 10 MHz and 100 MHz) may be designed to have distances 382, 384 that are a smaller fraction of one wavelength. For example, when system 300 is designed to produce an RF signal with an operational frequency of about 10 MHz (corresponding to a wavelength of about 30 meters), and distances 382, 384 are selected to be about 0.5 meters, the distances 382, 384 are about one 60th of one wavelength of the RF signal. Conversely, when system 300 is designed for an operational frequency of about 300 MHz (corresponding to a wavelength of about 1 meter), and distances 382, 384 are selected to be about 0.5 meters, the distances 382, 384 are about one half of one wavelength of the RF signal.

With the operational frequency and the distances 382, 384 between electrodes 340, 350 being selected to define a sub-resonant interior cavity 360, the first and second electrodes 340, 350 are capacitively coupled. More specifically, the first electrode 340 may be analogized to a first plate of a capacitor, the second electrode 350 may be analogized to a second plate of a capacitor, and the load 364, dielectric supports 346, 356, and air within the cavity 360 may be analogized to a capacitor dielectric. Accordingly, the first electrode 340 alternatively may be referred to herein as an "anode," and the second electrode 350 may alternatively be referred to herein as a "cathode."

Essentially, the voltage across the first and second electrodes 340, 350 (or the electromagnetic field between the electrodes 340, 350) heats the load 364 within the cavity 360. According to various embodiments, the RF subsystem 310 is configured to generate the RF signal to produce voltages across the electrodes 340, 350 in a range of about*70 volts to about 3000 volts, in one embodiment, or in a range of about 3000 volts to about 10,000 volts, in another embodiment, although the system may be configured to produce lower or higher voltages across electrodes 340, 350, as well.

An output of the RF subsystem 310, and more particularly an output of RF signal source 320, is electrically coupled to the variable matching subsystem 370 through a conductive transmission path, which includes a plurality of conductors 328-1, 328-2, 328-3, 328-4, and 328-5 connected in series, and referred to collectively as transmission path 328. According to an embodiment, the conductive transmission path 328 includes an "unbalanced" portion and a "balanced" portion, where the "unbalanced" portion is configured to carry an unbalanced RF signal (i.e., a single RF signal referenced against ground), and the "balanced" portion is configured to carry a balanced RF signal (i.e., two signals referenced against each other). The "unbalanced" portion of the transmission path 328 may include unbalanced first and second conductors 328-1, 328-2 within the RF subsystem 310, one or more connectors 336, 338 (each having male and female connector portions), and an unbalanced third conductor 328-3 electrically coupled between the connectors 336, 338. According to an embodiment, the third conductor 328-3 comprises a coaxial cable, although the electrical length may be shorter or longer, as well. In an alternate embodiment, the variable matching subsystem 370 may be housed with the RF subsystem 310, and in such an embodiment, the conductive transmission path 328 may exclude the connectors 336, 338 and the third conductor 328-3. Either way, the "balanced" portion of the conductive transmission path 328 includes a balanced fourth conductor 328-4 within the variable matching subsystem 370, and a balanced fifth conductor 328-5 electrically coupled between the variable matching subsystem 370 and electrodes 340, 350, in an embodiment.

As indicated in FIG. 3, the variable matching subsystem 370 houses an apparatus configured to receive, at an input of the apparatus, the unbalanced RF signal from the RF signal source 320 over the unbalanced portion of the transmission path (i.e., the portion that includes unbalanced conductors 328-1, 328-2, and 328-3), to convert the unbalanced RF signal into two balanced RF signals (e.g., two RF signals having a phase difference between 120 and 240 degrees, such as about 180 degrees), and to produce the two balanced RF signals at two outputs of the apparatus. For example, the conversion apparatus may be a balun 374, in an embodiment. The balanced RF signals are conveyed over balanced conductors 328-4 to the variable matching circuit 372 and, ultimately, over balanced conductors 328-5 to the electrodes 340, 350.

In an alternate embodiment, as indicated in a dashed box in the center of FIG. 3 and described in more detail later, an alternate RF signal generator 320' may produce balanced RF signals on balanced conductors 328-1', which may be directly coupled to the variable matching circuit 372 (or coupled through various intermediate conductors and connectors). In such an embodiment, the balun 374 may be excluded from the system 300. Either way, as will be described in more detail below, a double-ended variable matching circuit 372 is configured to receive the balanced RF signals (e.g., over connections 328-4 or 328-1'), to perform an impedance transformation corresponding to a then-current configuration of the double-ended variable matching circuit 372, and to provide the balanced RF signals to the first and second electrodes 340, 350 over connections 328-5.

According to an embodiment, RF signal source 320 includes an RF signal generator 322 and a power amplifier 324 (e.g., including one or more power amplifier stages). In response to control signals provided by system controller 312 over connection 314, RF signal generator 322 is configured to produce an oscillating electrical signal having a frequency in an ISM band, although the system could be modified to support operations in other frequency bands, as well. The RF signal generator 322 may be controlled to produce oscillating signals of different power levels and/or different frequencies, in various embodiments. For example, the RF signal generator 322 may produce a signal that oscillates in a range of about 10.0 MHz to about 100 MHz and/or from about 100 MHz to about 3.0 GHz. Some desirable frequencies may be, for example, 13.56 MHz (+/−5 percent), 27.125 MHz (+/−5 percent), 40.68 MHz (+/−5 percent), and 2.45 GHz (+/−5 percent). Alternatively, the frequency of oscillation may be lower or higher than the above-given ranges or values.

The power amplifier 324 is configured to receive the oscillating signal from the RF signal generator 322, and to amplify the signal to produce a significantly higher-power signal at an output of the power amplifier 324. For example, the output signal may have a power level in a range of about 100 watts to about 400 watts or more, although the power level may be lower or higher, as well. The gain applied by the power amplifier 324 may be controlled using gate bias voltages and/or drain bias voltages provided by the power supply and bias circuitry 326 to one or more stages of amplifier 324. More specifically, power supply and bias circuitry 326 provides bias and supply voltages to the inputs and/or outputs (e.g., gates and/or drains) of each RF amplifier stage in accordance with control signals received from system controller 312.

The power amplifier may include one or more amplification stages. In an embodiment, each stage of amplifier 324 is implemented as a power transistor, such as a FET, having an input terminal (e.g., a gate or control terminal) and two current carrying terminals (e.g., source and drain terminals). Impedance matching circuits (not illustrated) may be coupled to the input (e.g., gate) and/or output (e.g., drain terminal) of some or all of the amplifier stages, in various embodiments. In an embodiment, each transistor of the amplifier stages includes an LDMOS FET. However, it should be noted that the transistors are not intended to be limited to any particular semiconductor technology, and in other embodiments, each transistor may be realized as a GaN transistor, another type of MOS FET transistor, a BJT, or a transistor utilizing another semiconductor technology.

In FIG. 3, the power amplifier arrangement 324 is depicted to include one amplifier stage coupled in a particular manner to other circuit components. In other embodiments, the power amplifier arrangement 324 may include other amplifier topologies and/or the amplifier arrangement may include two or more amplifier stages (e.g., as shown in the embodiment of amplifier 224/225, FIG. 2). For example, the power amplifier arrangement may include various embodiments of a single-ended amplifier, a double-ended (balanced) amplifier, a push-pull amplifier, a Doherty amplifier, an SMPA, or another type of amplifier.

For example, as indicated in the dashed box in the center of FIG. 3, an alternate RF signal generator 320' may include a push-pull or balanced amplifier 324', which is configured to receive, at an input, an unbalanced RF signal from the RF signal generator 322, to amplify the unbalanced RF signal, and to produce two balanced RF signals at two outputs of the amplifier 324', where the two balanced RF signals are thereafter conveyed over conductors 328-1' to the electrodes 340, 350. In such an embodiment, the balun 374 may be excluded from the system 300, and the conductors 328-1' may be directly connected to the variable matching circuit 372 (or connected through multiple coaxial cables and connectors or other multi-conductor structures).

Cavity 360 and any load 364 (e.g., food, liquids, and so on) positioned in the cavity 360 present a cumulative load for the electromagnetic energy (or RF power) that is radiated into the interior chamber 360 by the electrodes 340, 350. More specifically, and as described previously, the cavity 360 and the load 364 present an impedance to the system, referred to herein as a "cavity plus load impedance." The cavity plus load impedance changes during a thermal increase operation as the temperature of the load 364 increases. The cavity plus load impedance has a direct effect on the magnitude of reflected signal power along the conductive transmission path 328 between the RF signal source 320 and the electrodes 340, 350. In most cases, it is desirable to maximize the magnitude of transferred signal power into the cavity 360, and/or to minimize the reflected-to-forward signal power ratio along the conductive transmission path 328.

In order to at least partially match the output impedance of the RF signal generator 320 to the chamber input impedance, a first matching circuit 334 is electrically coupled along the transmission path 328, in an embodiment. The first matching circuit 334 is configured to perform an impedance transformation from an impedance of the RF signal source 320 (e.g., less than about 10 ohms) to an intermediate impedance (e.g., 50 ohms, 35 ohms, or some other value). The first matching circuit 334 may have any of a variety of configurations. According to an embodiment, the first matching circuit 334 includes fixed components (i.e., components with non-variable component values), although the first matching circuit 334 may include one or more variable components, in other embodiments. For example, the first matching circuit 334 may include any one or more circuits selected from an LC network, a series inductance network, a shunt inductance network, or a combination of bandpass, high-pass and low-pass circuits, in various embodiments. Essentially, the first matching circuit 334 is configured to raise the impedance to an intermediate level between the output impedance of the RF signal generator 320 and the cavity plus load impedance.

According to an embodiment, power detection circuitry 330 is coupled along the transmission path 328 between the output of the RF signal source 320 and the electrodes 340, 350. In a specific embodiment, the power detection circuitry 330 forms a portion of the RF subsystem 310, and is coupled to the conductor 328-2 between the RF signal source 320 and connector 336. In alternate embodiments, the power detection circuitry 330 may be coupled to any other portion of the transmission path 328, such as to conductor 328-1, to conductor 328-3, to conductor 328-4 between the RF signal source 320 (or balun 374) and the variable matching circuit 372 (i.e., as indicated with power detection circuitry 330'), or to conductor 328-5 between the variable matching circuit 372 and the electrode(s) 340, 350 (i.e., as indicated with power detection circuitry 330"). For purposes of brevity, the power detection circuitry is referred to herein with reference number 330, although the circuitry may be positioned in other locations, as indicated by reference numbers 330' and 330".

Wherever it is coupled, power detection circuitry 330 is configured to monitor, measure, or otherwise detect the power of the reflected signals traveling along the transmission path 328 between the RF signal source 320 and one or both of the electrode(s) 340, 350 (i.e., reflected RF signals traveling in a direction from electrode(s) 340, 350 toward RF signal source 320). In some embodiments, power detection circuitry 330 also is configured to detect the power of the forward signals traveling along the transmission path 328 between the RF signal source 320 and the electrode(s) 340, 350 (i.e., forward RF signals traveling in a direction from RF signal source 320 toward electrode(s) 340, 350).

Over connection 332, power detection circuitry 330 supplies signals to system controller 312 conveying the measured magnitudes of the reflected signal power, and in some embodiments, also the measured magnitude of the forward signal power. In embodiments in which both the forward and reflected signal power magnitudes are conveyed, system controller 312 may calculate a reflected-to-forward signal power ratio, or the S11 parameter. When the reflected signal power magnitude exceeds a reflected signal power threshold, or when the reflected-to-forward signal power ratio exceeds an S11 parameter threshold, this indicates that the system 300 is not adequately matched to the cavity plus load impedance, and that energy absorption by the load 364 within the cavity 360 may be sub-optimal. In such a situation, system controller 312 orchestrates a process of altering the state of the variable matching circuit 372 to drive the reflected signal power or the S11 parameter toward or below a desired level (e.g., below the reflected signal power threshold and/or the reflected-to-forward signal power ratio threshold), thus re-establishing an acceptable match and facilitating more optimal energy absorption by the load 364.

More specifically, the system controller 312 may provide control signals over control path 316 to the variable matching circuit 372, which cause the variable matching circuit 372 to vary inductive, capacitive, and/or resistive values of one or more components within the circuit, thus adjusting the impedance transformation provided by the circuit 372. Adjustment of the configuration of the variable matching circuit 372 desirably decreases the magnitude of reflected signal power, which corresponds to decreasing the magnitude of the S11 parameter and increasing the power absorbed by the load 364.

As discussed above, the variable matching circuit 372 is used to match the input impedance of the cavity 360 plus load 364 to maximize, to the extent possible, the RF power transfer into the load 364. The initial impedance of the cavity 360 and the load 364 may not be known with accuracy at the beginning of a defrosting or heating operation. Further, the impedance of the load 364 changes during a defrosting or heating operation as the load 364 temperature increases. According to an embodiment, the system controller 312 may provide control signals to the variable matching circuit 372, which cause modifications to the state of the variable matching circuit 372. This enables the system controller 312 to establish an initial state of the variable matching circuit 372 at the beginning of the defrosting or heating operation that has a relatively low reflected to forward power ratio, and thus a relatively high absorption of the RF power by the load 364. In addition, this enables the system controller 312 to modify the state of the variable matching circuit 372 so that an adequate match may be maintained throughout the defrosting or heating operation, despite changes in the impedance of the load 364.

The variable matching circuit 372 may have any of a variety of configurations. For example, the circuit 372 may include any one or more circuits selected from an LC network, an inductance-only network, a capacitance-only network, or a combination of bandpass, high-pass and low-pass circuits, in various embodiments. In an embodiment in which the variable matching circuit 372 is implemented in a balanced portion of the transmission path 328, the variable matching circuit 372 is a double-ended circuit with two inputs and two outputs. In an alternate embodiment in which the variable matching circuit is implemented in an unbalanced portion of the transmission path 328, the variable matching circuit may be a single-ended circuit with a single input and a single output. According to a more specific embodiment, the variable matching circuit 372 includes a variable inductance network. According to another more specific embodiment, the variable matching circuit 372 includes a variable capacitance network. In still other embodiments, the variable matching circuit 372 may include both variable inductance and variable capacitance elements. The inductance, capacitance, and/or resistance values provided by the variable matching circuit 372, which in turn affect the impedance transformation provided by the circuit 372, are established through control signals from the system controller 312. In any event, by changing the state of the variable matching circuit 372 over the course of a treatment operation to dynamically match the ever-changing impedance of the cavity 360 plus the load 364 within the cavity 360, the system efficiency may be maintained at a high level throughout the defrosting or heating operation.

As discussed above, in each of the embodiments of FIGS. 2 and 3, one or more of electrodes 240, 240', 340, 350 is a "multi-level" electrode. As used herein, the term "multi-level", when referring to an electrode, means an electrode with an electromagnetic energy radiating surface (or "cavity-facing" surface) with multiple portions that are not co-planar with each other. Some or all of the non-co-planar portions may be flat (e.g., including substantially flat surfaces in different parallel or non-parallel planes), or some or all of the non-co-planar portions may be curved or rounded, in various embodiments.

Figure 4:
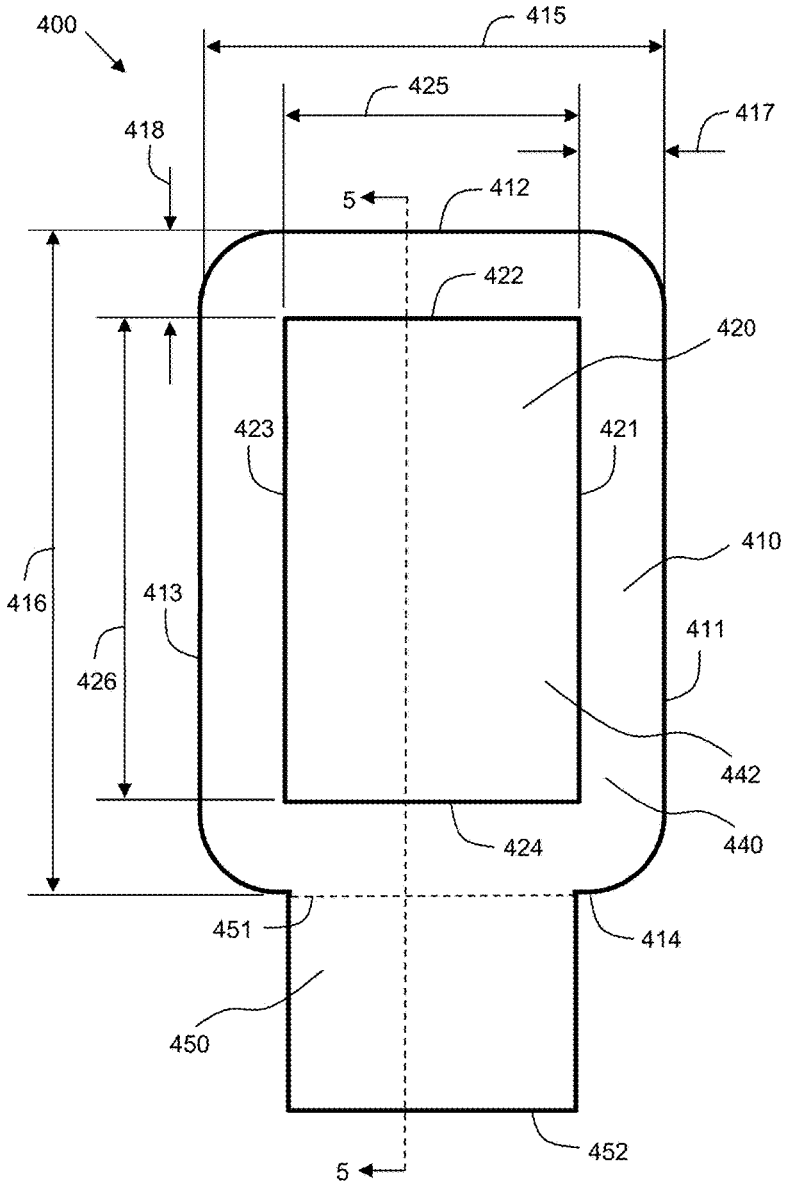
FIGS. 4 and 5 are top and side, cross-sectional views, respectively, of a multi-level electrode, in accordance with an example embodiment.
Figure 5:
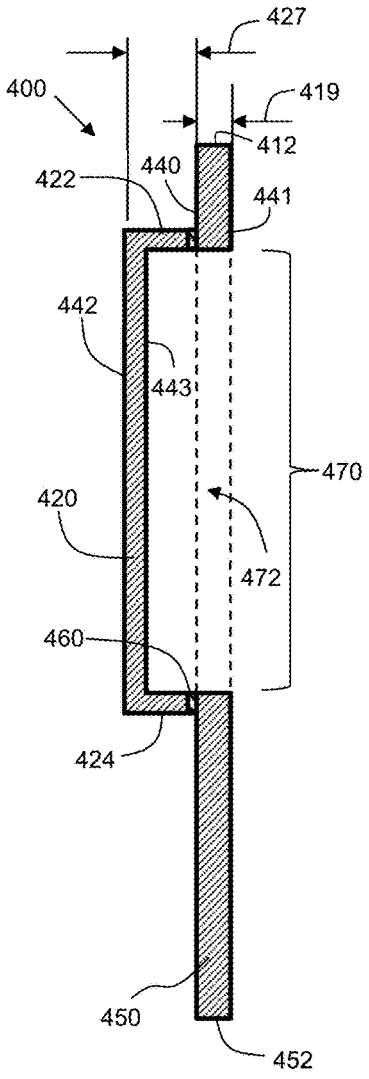

FIGS. 4 and 5 are top and side, cross-sectional views, respectively, of a multi-level electrode 400, in accordance with an example embodiment. More specifically, FIG. 4 is a top view of a multi-level electrode 400, and FIG. 5 is a side, cross-sectional view of the multi-level electrode 400 along line 5-5 of FIG. 4.

Electrode 400 includes a first electrode portion 410 (or "base" portion), a second electrode portion 420 (or "elevated" portion), and an extension portion 450. When integrated into a thermal increase system (e.g., any of systems 100, 200, 300, FIGS. 1-3), top surfaces 440, 442 of the first and second electrode portions 410, 420 are oriented to face toward the heating cavity (e.g., cavity 110, 260, 360, FIGS. 1-3). Thus, surfaces 440, 442 alternatively may be referred to as "cavity-facing" surfaces.

The extension portion 450 has a first end or edge 451 coupled to the first portion 410 of the electrode 400, and a second end or edge 452 that is configured to be physically and electrically connected to other portions of a thermal increase system (e.g., to an RF signal source 220, 320 through various conductors, connectors, and other circuitry 234, 270, 334, 372, 374, FIGS. 2, 3). Essentially, the extension portion 450 is configured to convey an RF signal from the second end or edge 452 to the first end or edge 451, which is electrically connected to the first electrode portion 410.

In some embodiments, the extension portion 450 may be formed from bulk electrically conductive material (e.g., copper, brass, aluminum, steel, or other electrically-conductive materials). In other embodiments, the extension portion 450 may include one or more layers of dielectric material and one or more electrical conductors (e.g., formed from one or more patterned conductive layers) that are configured to convey an RF signal from the second end or edge 452 to the first end or edge 451. Either way, the extension portion 450 may have a substantially rectangular shape, as shown in FIG. 4, or the extension portion 450 may have any of a variety of other shapes while maintaining its functionality.

As mentioned above, the extension portion 450 is electrically coupled to the first electrode portion 410. In some embodiments, the extension portion 450 and the first electrode portion 410 may be integrally formed together (e.g., from a single sheet of conductive material or a single substrate), as indicated in FIGS. 4 and 5. In other embodiments, the extension portion 450 and the first electrode portion 410 may be separately formed components that are physically and electrically connected together.

The first electrode portion 410 includes a top (or cavity-facing) surface 440, an opposed bottom surface 441, and a plurality of sides 411, 412, 413, 414. In the embodiment illustrated in FIG. 4, the first electrode portion 410 has a four-sided rectangular shape with rounded corners. In other embodiments, the first electrode portion 410 may have a different number of sides, sharp corners, beveled corners, and/or a shape other than a rectangular shape (e.g., a circular shape, oval shape, hexagonal shape, and so on). According to an embodiment, the first electrode portion 410 includes a central opening 470, indicated with dashed lines in FIG. 5, and the central opening 470 may have a corresponding shape to the shape of the second electrode portion 420.

The second electrode portion 420 also includes a top (or cavity-facing) surface 442, an opposed bottom surface 443, and a plurality of sidewalls 421, 422, 423, 424. In the embodiment illustrated in FIG. 4, the second electrode portion 420 has a four-sided rectangular shape with sharp corners. In other embodiments, the second electrode portion 420 may have a different number of sides, rounded corners, beveled corners, and/or a shape other than a rectangular shape (e.g., a circular shape, oval shape, hexagonal shape, and so on).

As best seen in FIG. 5, the first and second electrode portions 410, 420 are connected together so that the second electrode portion 420 substantially covers the central opening 470 of the first electrode portion 410. For example, the sidewalls 421-424 of the second electrode portion 420 may extend in a direction that is perpendicular to the top surface 442 of the second electrode portion 420 (i.e., in a direction toward the first electrode portion 410, when the first and second electrode portions 410, 420 are connected). The connection between the first and second electrode portions 410, 420 may be made at edges of the sidewalls 421-424 that are distal from the top surface 442 of the second electrode portion 420. According to various embodiments, a conductive attachment material 460 may be used to connect the first and second electrode portions 410, 420. For example, the conductive attachment material 460 may include solder, conductive adhesive, brazing, sintering, or other suitable electrically-conductive materials. According to an embodiment, the first and second electrode portions 410, 420 are electrically connected together (e.g., through conductive attachment material 460).

According to an embodiment, the second electrode portion 420 includes a central cavity 472 defined by the bottom surface 443 and interior surfaces of the sidewalls 421-424. The first and second electrode portions 410, 420 are coupled together so that the central cavity 472 is aligned with the central opening 470 of the first electrode portion 410.

Although the first and second electrode portions 410, 420 have substantially planar top surfaces 440, 442 (i.e., the topographies of the top surfaces 440, 442 are planar), as indicated in the embodiment illustrated in FIGS. 4 and 5, in alternate embodiments, the topographies of the top surfaces 440, 442 of the first and/or second electrode portions 410, 420 may be non-planar (e.g., a curved topography, a domed topography, a pyramid shaped topography, a topography with a triangular cross-section, a topography with a saw-tooth-shaped cross-section, or an otherwise irregularly shaped topography).

The first and second electrode portions 410, 420 each have a thickness (e.g., thickness 419) that is sufficient to render the first and second electrode portions 410, 420 substantially rigid. For example, the thicknesses of the first and second electrode portions 410, 420 may be in a range of about 20 mils to 500 mils, although the electrode portions 410, 420 may be thinner or thicker, as well.

According to an embodiment, a height 427 of the top surface 442 (or radiating surface) of the second electrode portion 420 above the top surface 440 (or radiating surface) of the first electrode portion 410 is in a range of about 0.5 centimeters (cm) to about 5 cm (e.g., in a range of about 1.0 cm to about 2.0 cm), although the height 427 may be smaller or larger, as well. The widths 415, 425 and the lengths 416, 426 of the first and second electrode portions 410, 420 each may be in a range of about 5 cm to about 30 cm, in an embodiment. In various embodiments, the width 415 and/or the length 416 of the first electrode portion 410 are in a range of about 20 percent to about 75 percent larger than the width 425 and/or length 426 of the second electrode portion 420 (e.g., the first electrode portion 410 may be about 15 cm×20 cm, and the second electrode portion 420 may be about 8 cm×10 cm). Said another way, the area (including the area of the central opening 470) or perimeter of the top surface 440 of the first electrode portion 410 is significantly larger (e.g., in a range of about 50 percent to about 400 percent larger) than the area or perimeter of the top surface 442 of the second electrode portion 420. According to an embodiment, distances (e.g., distances 417, 418) between parallel and adjacent sides 411/421, 412/422, 413/423, 414/424 of the first and second electrode portions 410, 420 are in a range of about 2 cm to about 10 cm, although the distances between some or all of the parallel and adjacent sides may be smaller or larger, as well.

The first and second electrode portions 410, 420 may be formed from bulk electrically conductive material (e.g., copper, brass, aluminum, steel, or other electrically-conductive materials). In other embodiments, the first and/or second electrode portions 410, 420 may include one or more layers of dielectric material and one or more conductive layers (e.g., a conductive layer applied to the surface of the first and/or second electrode portions 410, 420, or embedded within the first and/or second electrode portions 410, 420) that are configured to radiate electromagnetic energy in a direction substantially perpendicular to the top surfaces 440, 442 of the first and second electrode portions 410, 420 (e.g., toward a center of a heating cavity (e.g., cavity 260, 360, FIGS. 2, 3).

Each of the first electrode portion 410 and the second electrode portion 420 include cavity-facing surfaces 440, 442 that are suitable for radiating electromagnetic energy in response to receiving an RF signal. In each of the above-described embodiments, the first and second electrode portions 410, 420 are configured to receive RF signals from other portions of a thermal increase system (e.g., to an RF signal source 220, 320, FIGS. 2, 3) through the extension portion 450, and to convert the received RF signals into electromagnetic radiation that radiates from at least the cavity-facing surfaces 440, 442 of the first and second electrode portions 410, 420.

When integrated into a thermal increase system (e.g., any of systems 100, 200, 300, FIGS. 1-3), the electromagnetic radiation produced by the multi-level electrode 400 radiates into a heating cavity of the system (e.g., cavity 110, 260, 360, FIGS. 1-3). In the embodiment of FIGS. 4 and 5, multi-level electrode 400 includes a planar conductive peripheral section (or first electrode portion 410) and a hollow, elevated central conductive "island" (or second electrode portion 420), and the electrode 400 is arranged in the thermal increase system so that the island protrudes into the cavity (e.g., toward a food load in the cavity). In other words, as depicted in FIGS. 2 and 3, the second electrode portion 420 may be co-planar with a plane (e.g., plane 245, 345, 355, FIGS. 2, 3) that is closer to the center of the cavity than a second plane (e.g., plane 243, 343, 353, FIGS. 2, 3) with which the first electrode portion 410 is co-planar. Because the top surface 442 of the second electrode portion 420 is higher (i.e., closer to the center of the heating cavity) than the top surface 440 of the first electrode portion 410, the electrical field radiated into the cavity by the multi-level electrode 400 is different from an electromagnetic field that would be produced by a single-level (i.e., substantially planar) electrode.

In the embodiment of FIGS. 4 and 5, a multi-level electrode 400 with a multi-level radiating surface (including surfaces 440, 442) is formed by joining a first and second electrode portion 410, 420 together, and the multi-level electrode 400 has a central cavity 472. As will be described below, alternative embodiments of multi-level electrodes 600, 700 may be differently configured while still having a multi-level radiating surface.

Figure 6:
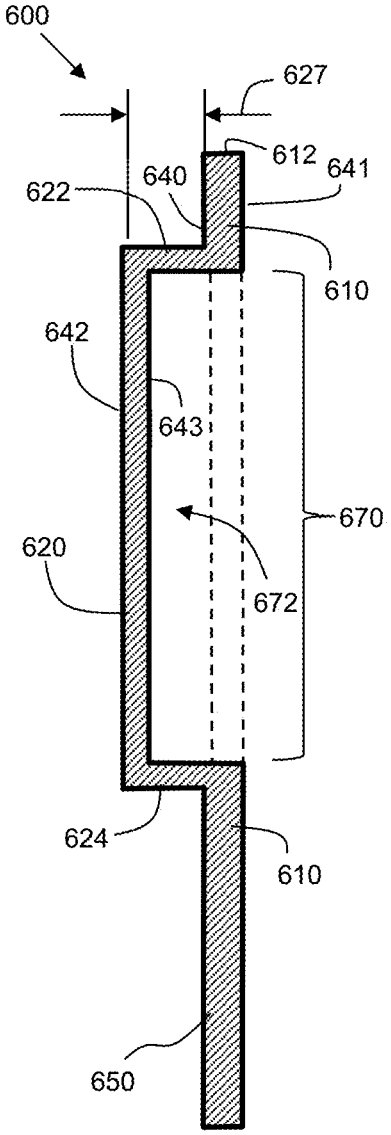
FIGS. 6 and 7 are side, cross-sectional views of two additional embodiments of a multi-level electrode.
Figure 7:
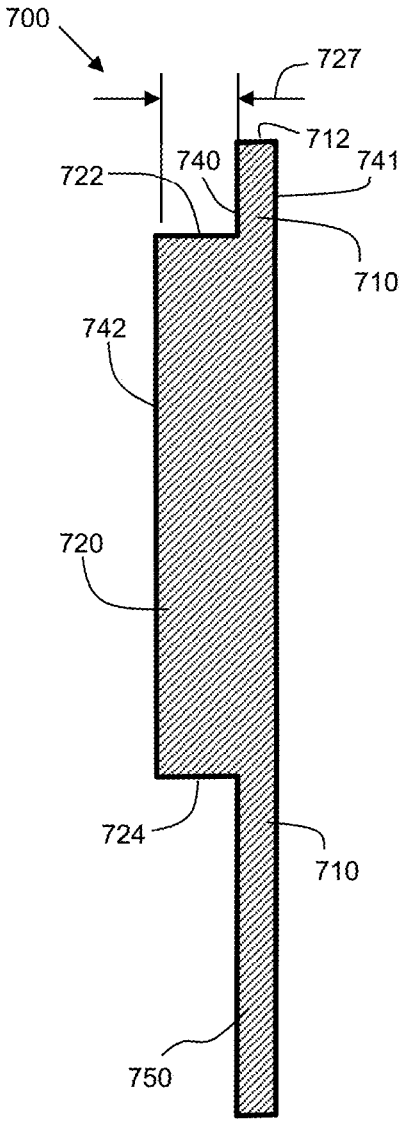

For example, FIGS. 6 and 7 are side, cross-sectional views of multi-level electrodes 600, 700 according to two additional embodiments. The multi-level electrode 600 of FIG. 6 may be substantially similar to the multi-level electrode 400 of FIGS. 4 and 5, in that electrode 600 also includes an electromagnetic energy radiating surface (or "cavity-facing" surface) with multiple portions that are not co-planar with each other. More specifically, electrode 600 includes a first electrode portion 610 (or "base" portion), a second electrode portion 620 (or "elevated" portion), and an extension portion 650. When integrated into a thermal increase system (e.g., any of systems 100, 200, 300, FIGS. 1-3), top surfaces 640, 642 of the first and second electrode portions 610, 620 are oriented to face toward the heating cavity (e.g., cavity 110, 260, 360, FIGS. 1-3). More specifically, the hollow, elevated central conductive "island" (or second electrode portion 620) is arranged in the thermal increase system so that the island protrudes into the cavity (e.g., toward a food load in the cavity).

The extension portion 650 may be identical or substantially similar to extension portion 450 (FIG. 4), including the various embodiments of extension portion 450 described above in conjunction with FIG. 4. Essentially, the extension portion 650 is formed from bulk electrically conductive material or from one or more layers of dielectric material and one or more electrical conductors, and is configured to convey an RF signal to the first electrode portion 610. The extension portion 650 and the first electrode portion 610 may be integrally formed together (e.g., from a single sheet of conductive material or a single substrate), or the extension portion 650 and the first electrode portion 610 may be separately formed components that are physically and electrically connected together.

The first electrode portion 610 includes a top (or cavity-facing) surface 640, an opposed bottom surface 641, and a plurality of sides 612, only one of which is depicted in the cross-section of FIG. 6. As with the first electrode portion 410 of FIG. 4, the first electrode portion 610 may have a four-sided rectangular shape with rounded corners. Alternatively, the first electrode portion 610 may have a different number of sides, sharp corners, beveled corners, and/or a shape other than a rectangular shape (e.g., a circular shape, oval shape, hexagonal shape, and so on). According to an embodiment, the first electrode portion 610 includes a central opening 670, indicated with dashed lines in FIG. 6.

The second electrode portion 620 also includes a top (or cavity-facing) surface 642, an opposed bottom surface 643, and a plurality of sidewalls 622, 624, only two of which are depicted in the cross-section of FIG. 6. As with the second electrode portion 420 of FIG. 4, the second electrode portion 620 may have a four-sided rectangular shape with sharp corners. Alternatively, the second electrode portion 620 may have a different number of sides, rounded corners, beveled corners, and/or a shape other than a rectangular shape (e.g., a circular shape, oval shape, hexagonal shape, and so on).

The second electrode portion 620 substantially covers the central opening 670 of the first electrode portion 610. In contrast with the electrode 400 of FIG. 4, the first and second electrode portions 610, 620 are integrally formed together. For example, the second electrode portion 620 may be formed by stamping or otherwise forming a central cavity 672 (and thus the central opening 670) from a planar conductive sheet of material, where the unstamped portion of the planar conductive sheet of material may correspond to the first electrode portion 610.

Although the first and second electrode portions 610, 620 have substantially planar top surfaces 640, 642 (i.e., the topographies of the top surfaces 640, 642 are planar), as indicated in the embodiment illustrated in FIG. 6, in alternate embodiments, the topographies of the top surfaces 640, 642 of the first and/or second electrode portions 610, 620 may be non-planar (e.g., a curved topography, a domed topography, a pyramid shaped topography, a topography with a triangular cross-section, a topography with a saw-tooth-shaped cross-section, or an otherwise irregularly shaped topography).

According to an embodiment, a height 627 of the top surface 642 of the second electrode portion 620 above the top surface 640 of the first electrode portion 610 is in a range of about 0.5 cm to about 5 cm (e.g., in a range of about 1.0 cm to about 2.0 cm), although the height 627 may be smaller or larger, as well. The widths and the lengths of the first and second electrode portions 610, 620 each may be in a range of about 5 cm to about 30 cm, in an embodiment. In various embodiments, the width and/or the length of the first electrode portion 610 are in a range of about 20 percent to about 75 percent larger than the width and/or length of the second electrode portion 620 (e.g., the area, including the area of the central opening 670, or perimeter of the top surface 640 of first electrode portion 610 is significantly larger (e.g., in a range of about 50 percent to about 400 percent larger) than the area or perimeter of the top surface 642 of the second electrode portion 620).

The first and second electrode portions 610, 620 may be formed from bulk electrically conductive material (e.g., copper, brass, aluminum, steel, or other electrically-conductive materials). Alternatively, the first and/or second electrode portions 610, 620 may include one or more layers of dielectric material and one or more conductive layers (e.g., a conductive layer applied to the surface of the first and/or second electrode portions 610, 620, or embedded within the first and/or second electrode portions 610, 620) that are configured to radiate electromagnetic energy in a direction substantially perpendicular to the top surfaces 640, 642 of the first and second electrode portions 610, 620 (e.g., toward a center of a heating cavity (e.g., cavity 260, 360, FIGS. 2, 3)) in response to receiving an RF signal from other portions of a thermal increase system.

Turning now to FIG. 7, the multi-level electrode 700 of FIG. 7 also may be substantially similar to the multi-level electrodes 400, 600 of FIGS. 4-6, in that electrode 700 also includes an electromagnetic energy radiating surface (or "cavity-facing" surface) with multiple portions that are not co-planar with each other. More specifically, electrode 700 includes a first electrode portion 710 (or "base" portion), a second electrode portion 720 (or "elevated" portion), and an extension portion 750. The major distinction between electrode 700 and electrodes 400, 600 (FIGS. 4-6) is that electrode 700 has a solid, elevated central conductive "island" (or second electrode portion 720), rather than a hollow central conductive island. When integrated into a thermal increase system (e.g., any of systems 100, 200, 300, FIGS. 1-3), top surfaces 740, 742 of the first and second electrode portions 710, 720 are oriented to face toward the heating cavity (e.g., cavity 110, 260, 360, FIGS. 1-3). More specifically, the solid, elevated central conductive island (or second electrode portion 720) is arranged in the thermal increase system so that the island protrudes into the cavity (e.g., toward a food load in the cavity).

The extension portion 750 may be identical or substantially similar to extension portion 450 (FIG. 4), including the various embodiments of extension portion 450 described above in conjunction with FIG. 4. Essentially, the extension portion 750 is formed from bulk electrically conductive material or from one or more layers of dielectric material and one or more electrical conductors, and is configured to convey an RF signal to the first electrode portion 710. The extension portion 750 and the first electrode portion 710 may be integrally formed together (e.g., from a single sheet of conductive material or a single substrate), or the extension portion 750 and the first electrode portion 710 may be separately formed components that are physically and electrically connected together.

The first electrode portion 710 includes a top (or cavity-facing) surface 740, an opposed bottom surface 741, and a plurality of sides 712, only one of which is depicted in the cross-section of FIG. 7. As with the first electrode portion 410 of FIG. 4, the first electrode portion 710 may have a four-sided rectangular shape with rounded corners. Alternatively, the first electrode portion 710 may have a different number of sides, sharp corners, beveled corners, and/or a shape other than a rectangular shape (e.g., a circular shape, oval shape, hexagonal shape, and so on). In contrast with the first electrode portion 410 of FIG. 4, the first electrode portion 710 does not include a central opening, but instead has a substantially-planar bottom surface 741.

The second electrode portion 720 includes a top (or cavity-facing) surface 742 and a plurality of sidewalls 722, 724, only two of which are depicted in the cross-section of FIG. 7. As with the second electrode portion 420 of FIG. 4, the second electrode portion 720 may have a four-sided rectangular shape with sharp corners. Alternatively, the second electrode portion 720 may have a different number of sides, rounded corners, beveled corners, and/or a shape other than a rectangular shape (e.g., a circular shape, oval shape, hexagonal shape, and so on).

The second electrode portion 720 may integrally-formed with the first electrode portion 710, may be attached to the top surface 740 of the first electrode portion 710, or may be nested within an opening in the first electrode portion 710. In various embodiments, the first and second electrode portions 710, 720 may be cast together (e.g., in a mold), attached together (e.g., with solder, conductive adhesive, brazing, sintering, or other suitable electrically-conductive materials), or otherwise formed together.

Although the first and second electrode portions 710, 720 have substantially planar top surfaces 740, 742 (i.e., the topographies of the top surfaces 740, 742 are planar), as indicated in the embodiment illustrated in FIG. 7, in alternate embodiments, the topographies of the top surfaces 740, 742 of the first and/or second electrode portions 710, 720 may be non-planar (e.g., a curved topography, a domed topography, a pyramid shaped topography, a topography with a triangular cross-section, a topography with a saw-tooth-shaped cross-section, or an otherwise irregularly shaped topography).

According to an embodiment, a height 727 of the top surface 742 of the second electrode portion 720 above the top surface 740 of the first electrode portion 710 is in a range of about 0.5 cm to about 5 cm (e.g., in a range of about 1.0 cm to about 2.0 cm), although the height 727 may be smaller or larger, as well. The widths and the lengths of the first and second electrode portions 710, 720 each may be in a range of about 5 cm to about 30 cm, in an embodiment. In various embodiments, the width and/or the length of the first electrode portion 710 are in a range of about 20 percent to about 75 percent larger than the width and/or length of the second electrode portion 720 (e.g., the area or perimeter of the top surface 740 of first electrode portion 710 is significantly larger (e.g., in a range of about 50 percent to about 400 percent larger) than the area or perimeter of the top surface 742 of the second electrode portion 720).

The first and second electrode portions 710, 720 may be formed from bulk electrically conductive material (e.g., copper, brass, aluminum, steel, or other electrically-conductive materials). Alternatively, the first and/or second electrode portions 710, 720 may include one or more layers of dielectric material and one or more conductive layers (e.g., a conductive layer applied to the surface of the first and/or second electrode portions 710, 720, or embedded within the first and/or second electrode portions 710, 720) that are configured to radiate electromagnetic energy in a direction substantially perpendicular to the top surfaces 740, 742 of the first and second electrode portions 710, 720 (e.g., toward a center of a heating cavity (e.g., cavity 260, 360, FIGS. 2, 3)) in response to receiving an RF signal from other portions of a thermal increase system.

As mentioned previously, a multi-level electrode (e.g., electrodes 240, 240', 340, 350, 400, 600, 700, FIGS. 2-7) may be nested within a dielectric support (e.g., housing 246, 346, 356, FIGS. 2, 3) or "dielectric housing", which may include a contoured inner cavity configured to receive the electrode, and a substantially planar outer surface (e.g., the surface that faces cavity 260, 360 when the assembly is integrated into a thermal increase system (e.g., system 100, 200, 300, FIGS. 1-3).

Figure 8:
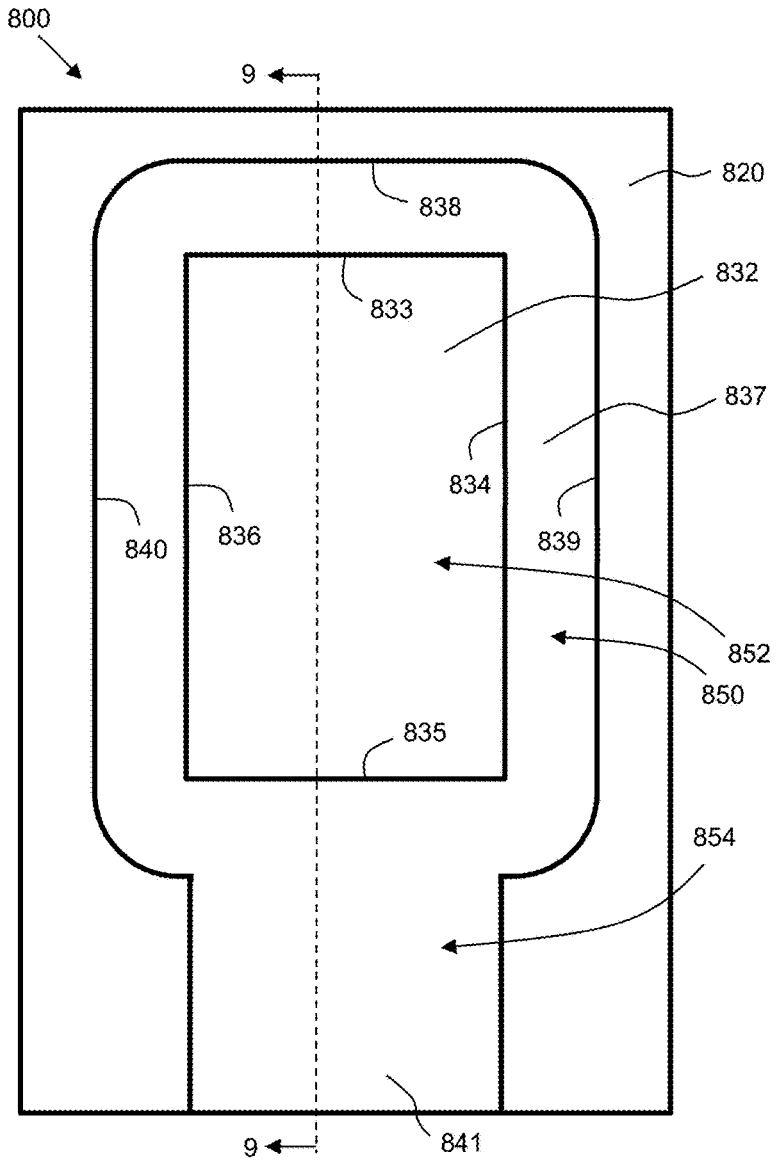
FIGS. 8 and 9 are bottom and side, cross-sectional views, respectively, of a dielectric housing for a multi-level electrode, in accordance with an example embodiment.
Figure 9:
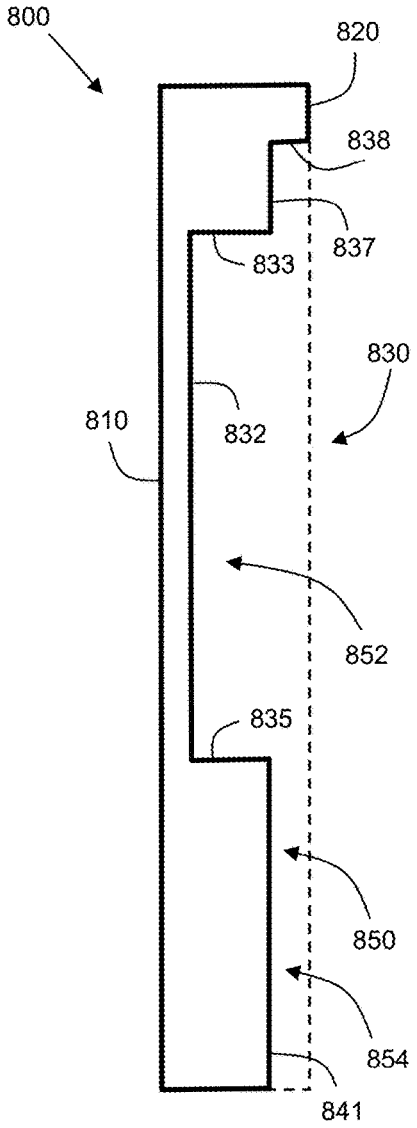

FIGS. 8 and 9 are bottom and side, cross-sectional views, respectively, of a dielectric support 800 (e.g., dielectric support 246, 346, 356, FIGS. 2, 3) configured to receive or support a multi-level electrode (e.g., electrodes 240, 240', 340, 350, 400, 600, 700, FIGS. 2-7), in accordance with an example embodiment. More specifically, FIG. 8 is a bottom view of a dielectric support 800, and FIG. 9 is a side, cross-sectional view of the dielectric support 800 along line 9-9 of FIG. 8.

Dielectric support 800 is formed from one or more solid dielectric (i.e., non-electrically conductive) materials, in an embodiment. For example, dielectric support 800 may be formed from one or more materials selected from a ceramic material, a glass, a polymer, or another suitably non-conductive material. In some specific embodiments, dielectric support 800 may be formed from polytetrafluoroethylene (PTFE), high density polyethylene (HDPE), or other suitable materials. In some embodiments, an entirety of dielectric support 800 is formed from a single bulk dielectric material. In other embodiments, dielectric support 800 may be formed from multiple layers of the same or different dielectric materials, and/or from multiple constituent parts that are attached together to form the dielectric support 800.

Essentially, dielectric support 800 includes a substantially-planar outer surface 810 and a cavity 830 in an opposite surface 820 from the outer surface 810. The cavity 830 is defined by a plurality of interior surfaces 832, 833, 834, 835, 836, 837, 838, 839, 840, 841, and the cavity 830 may be shaped and contoured so that substantially all of a corresponding multi-level electrode (e.g., electrodes 240, 240', 340, 350, 400, 600, 700, FIGS. 2-7) may fit or be nested within the cavity 830. More specifically, the cavity 830 is shaped and contoured so that at least one surface of a corresponding multi-level electrode will contact at least one interior surface 832-841 of the cavity 830, when the multi-level electrode is nested within the cavity 830 of the dielectric support 800.

For example, the cavity 830 may have a first cavity portion 850 configured to accept a base or first electrode portion (e.g., first electrode portions 410, 610, 710, FIGS. 4-7), a second cavity portion 852 configured to accept an elevated or second electrode portion (e.g., second electrode portion 420, 620, 720, FIGS. 4-7), and a third cavity portion 854 configured to accept an extension portion (e.g., extension portion 450, 650, 750, FIGS. 4-7). In some embodiments, the dimensions of the first, second, and third cavity portions 840, 842, 844 are selected to be slightly larger than the corresponding dimensions of the first electrode portion, the second electrode portion, and the extension portion, respectively, so that the electrode can be easily nested into the cavity 830 of the dielectric support 800 (e.g., the exterior surfaces of the electrode may make contact with the interior surfaces 832-841 of the cavity 830 when the electrode is nested in the cavity 830). In other embodiments, the cavity 830 may be less specifically contoured to the exterior surfaces of the electrode so that open spaces may be present between the electrode surfaces and the interior surfaces 832-841 of the cavity 830 when the electrode is nested within the dielectric support 800.

Figure 10:
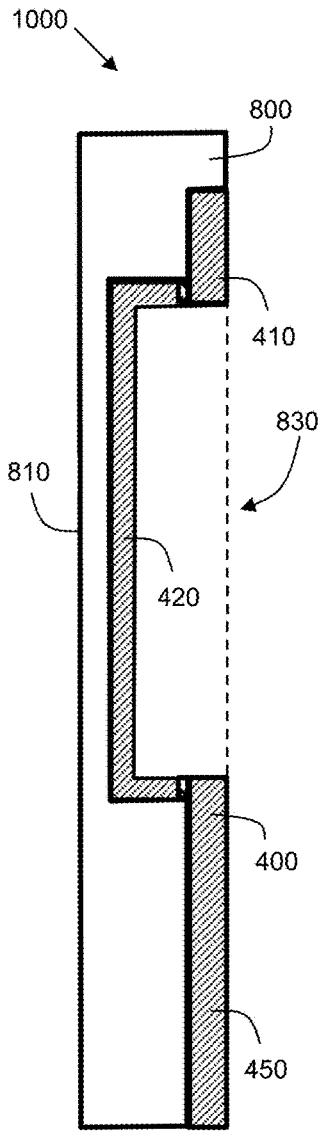
FIGS. 10-12 are side-cross-sectional views of three embodiments of a multi-level electrode coupled with an embodiment of a dielectric housing.
Figure 11:
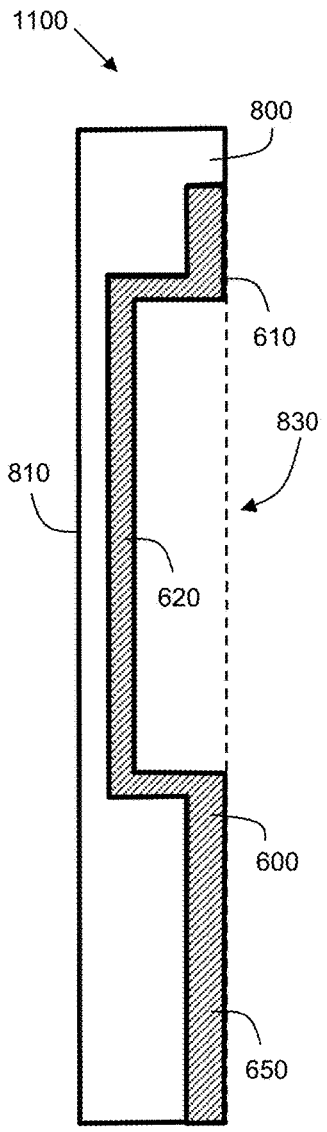
Figure 12:
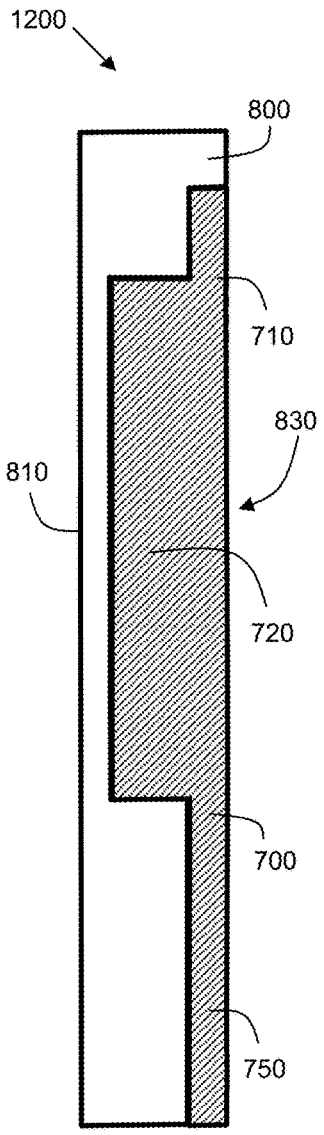

FIGS. 10-12 are side-cross-sectional views of three embodiments of electrode-housing assemblies 1000, 1100, 1200, each of which includes a multi-level electrode (e.g., electrodes 400, 600, 700, FIGS. 4-7) coupled with an embodiment of a dielectric housing (e.g., housing 800, FIG. 8). More specifically, FIG. 10 shows an assembly 1000 that includes the embodiment of electrode 400 (FIG. 4) nested within opening 830 of dielectric housing 800 (FIG. 8). More specifically, the base portion 410 of electrode 400 is received within a first cavity portion (e.g., portion 850, FIG. 8) of housing 800, the elevated portion 420 of electrode 400 is received within a second cavity portion 832 of housing 800, and the extension portion 450 of electrode 400 is received within a third cavity portion 834 of housing 800.

Similarly, FIG. 11 shows an assembly 1100 that includes the embodiment of electrode 600 (FIG. 6) nested within opening 830 of dielectric housing 800 (FIG. 8). More specifically, the base portion 610 of electrode 600 is received within a first cavity portion (e.g., portion 850, FIG. 8) of housing 800, the elevated portion 620 of electrode 600 is received within a second cavity portion 832 of housing 800, and the extension portion 650 of electrode 400 is received within a third cavity portion 834 of housing 800.

Further still, FIG. 12 shows an assembly 1200 that includes the embodiment of electrode 700 (FIG. 7) nested within opening 830 of dielectric housing 800 (FIG. 8). More specifically, the base portion 710 of electrode 700 is received within a first cavity portion (e.g., portion 850, FIG. 8) of housing 800, the elevated portion 720 of electrode 700 is received within a second cavity portion 832 of housing 800, and the extension portion 750 of electrode 400 is received within a third cavity portion 834 of housing 800.

In each of the embodiments of FIGS. 10-12, the exterior surfaces of the base portion 410, 610, 710, elevated portion 420, 620, 720, and extension portion 450, 650, 750 may contact the interior surfaces of the cavity 830 when the electrode 400, 600, 700 is nested within the cavity 830. In some embodiments, the exterior surfaces of the base portion 410, 610, 710, elevated portion 420, 620, 720, and extension portions 450, 650, 750 may be adhered to the interior surfaces of the cavity 830. Alternatively, the electrode 400, 600, 700 may simply be press-fit into the cavity 830, or otherwise secured within the cavity.

When an assembly (e.g., assemblies 1000, 1100, 1200, FIGS. 10-120 that includes an electrode nested into the dielectric support 800 is integrated within a thermal increase system (e.g., system 100, 200, 300, FIGS. 1-3), the dielectric support 800 essentially flattens (or renders flat) the associated interior surface of the heating cavity (e.g., cavity 260, 360, FIGS. 2, 3). When the assembly is associated with a top electrode (e.g., electrode 240, 240', 340, FIGS. 2, 3), for example, the cavity-facing surface of the dielectric support (e.g., surface 810, FIGS. 8-12) may correspond to or be parallel with and adjacent to a top cavity wall (e.g., wall 170, FIG. 1). When the assembly is associated with a bottom electrode (e.g., electrode 350, FIG. 3), for example, the cavity-facing surface of the dielectric support (e.g., surface 810, FIGS. 8-12) may correspond to or be parallel with and adjacent to a bottom cavity wall (e.g., wall 172, FIG. 1). Essentially, the dielectric support renders the bottom surface of the cavity flat, which facilitates physical stability of a load (e.g., load 364, FIG. 3) that may be placed on the cavity-facing surface of the dielectric support.

Figure 13:
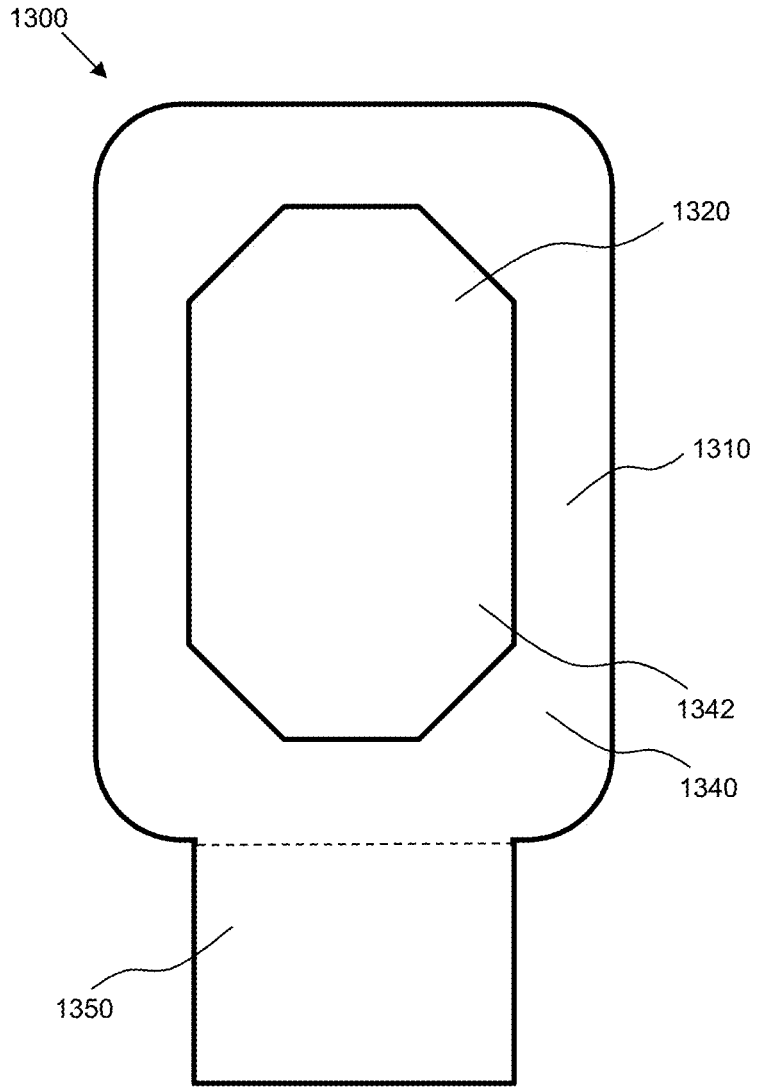
FIGS. 13 and 14 are top views of two additional embodiments of a multi-level electrode.

Although various specific configurations of multi-level electrodes and dielectric supports have been described above in conjunction with FIGS. 4-12, embodiments of electrodes and/or dielectric supports may have other shapes and configurations, while still falling within the scope of the inventive subject matter. For example, several additional embodiments of multi-level electrodes will now be described in conjunction with FIGS. 13-18. Turning first to FIG. 13, a top view of a multi-level electrode 1300 is shown. Multi-level electrode 1300 includes an electromagnetic energy radiating surface (or "cavity-facing" surface) with multiple portions that are not co-planar with each other. More specifically, electrode 1300 includes a first electrode portion 1310 (or "base" portion), a second electrode portion 1320 (or "elevated" portion), and an extension portion 1350. Electrode 1300 is similar to any of electrodes 400, 600, 700 (FIGS. 4-7), and the various embodiments discussed above with respect to those electrodes, with the exception that the shape of the perimeter of the second electrode portion 1330 is hexagonal, rather than rectangular. In various embodiments, the hexagonally-shaped second electrode portion 1320 may be hollow (e.g., similar to second electrode portions 420, 620, FIGS. 4-6), or may be in the form of a solid, elevated central conductive island (e.g., similar to second electrode portion 720, FIG. 7). In addition, the second electrode portion 1320 may be attached to the first electrode portion 1310 in some embodiments (e.g., with solder, conductive adhesive, brazing, sintering, or other suitable electrically-conductive materials, as with second electrode portion 420, FIGS. 4, 5), or the first and second electrode portions 1310, 1320 may be integrally-formed (e.g., as with second electrode portions 620, 720, FIGS. 6, 7).

The first electrode portion 1310 includes a top (or cavity-facing) surface 1340, and the second electrode portion 1320 includes a top (or cavity-facing) surface 1342. In various embodiments, the topographies of the top surfaces 1340, 1342 of the first and/or second electrode portions 1310, 1320 may be planar or non-planar (e.g., a curved topography, a domed topography, a pyramid shaped topography, a topography with a triangular cross-section, a topography with a sawtooth-shaped cross-section, or an otherwise irregularly shaped topography).

The first and second electrode portions 1310, 1320 may be formed from bulk electrically conductive material (e.g., copper, brass, aluminum, steel, or other electrically-conductive materials). Alternatively, the first and/or second electrode portions 1310, 1320 may include one or more layers of dielectric material and one or more conductive layers (e.g., a conductive layer applied to the surface of the first and/or second electrode portions 1310, 1320, or embedded within the first and/or second electrode portions 1310, 1320) that are configured to radiate electromagnetic energy in a direction substantially perpendicular to the top surfaces 1340, 1342 of the first and second electrode portions 1310, 1320 (e.g., toward a center of a heating cavity (e.g., cavity 260, 360, FIGS. 2, 3)) in response to receiving an RF signal from other portions of a thermal increase system.

The extension portion 1350 may be identical or substantially similar to extension portion 450 (FIG. 4), including the various embodiments of extension portion 450 described above in conjunction with FIG. 4. The extension portion 1350 may be formed from bulk electrically conductive material or from one or more layers of dielectric material and one or more electrical conductors, and the extension portion 1350 is configured to convey an RF signal to the first electrode portion 1310. The extension portion 1350 and the first electrode portion 1310 may be integrally formed together (e.g., from a single sheet of conductive material or a single substrate), or the extension portion 1350 and the first electrode portion 1310 may be separately formed components that are physically and electrically connected together.

When assembled into a thermal increase system (e.g., any of systems 100, 200, 300, FIGS. 1-3), the multi-level electrode 1300 may be nested into a correspondingly shaped dielectric housing (e.g., similar to dielectric housing 800, FIGS. 8 and 9), as previously described.

Figure 14:
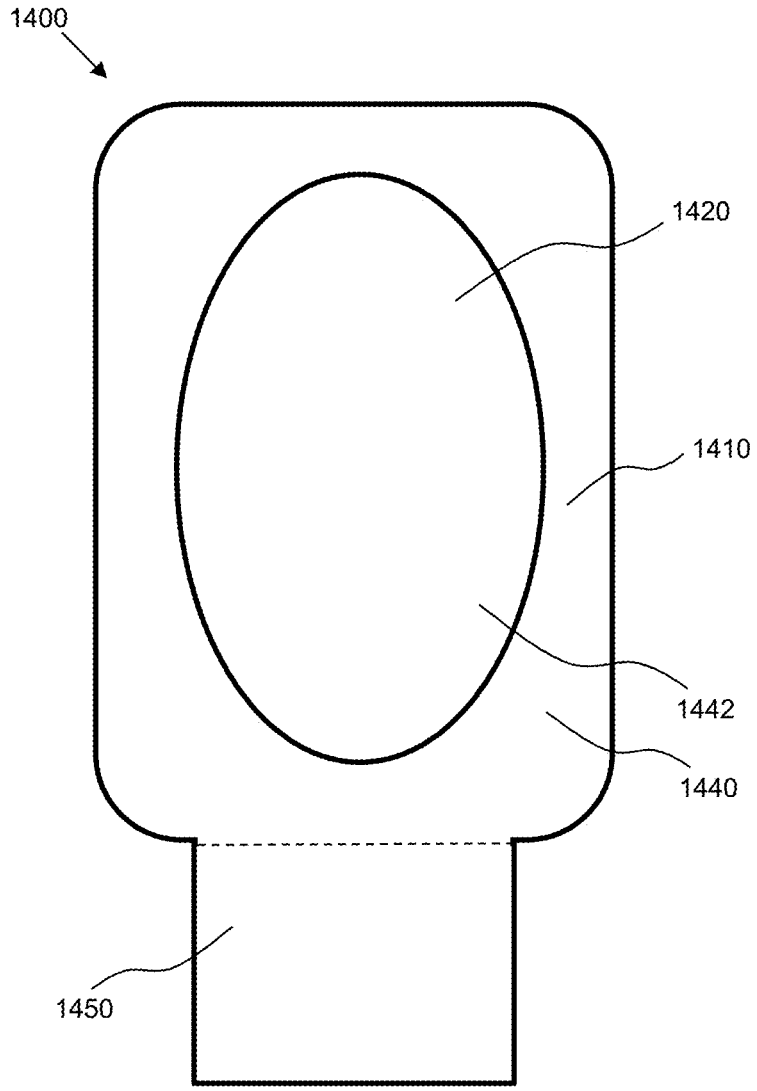

Turning next to FIG. 14, a top view of yet another embodiment of a multi-level electrode 1400 is shown. Multi-level electrode 1400 includes an electromagnetic energy radiating surface (or "cavity-facing" surface) with multiple portions that are not co-planar with each other. More specifically, electrode 1400 includes a first electrode portion 1410 (or "base" portion), a second electrode portion 1420 (or "elevated" portion), and an extension portion 1450. Electrode 1400 is similar to any of electrodes 400, 600, 700, 1300 (FIGS. 4-7, 13), and the various embodiments discussed above with respect to those electrodes, with the exception that the shape of the perimeter of the second electrode portion 1430 is oval, rather than rectangular or hexagonal. In various embodiments, the oval-shaped second electrode portion 1420 may be hollow (e.g., similar to second electrode portions 420, 620, FIGS. 4-6), or may be in the form of a solid, elevated central conductive island (e.g., similar to second electrode portion 720, FIG. 7). In addition, the second electrode portion 1420 may be attached to the first electrode portion 1410 in some embodiments (e.g., with solder, conductive adhesive, brazing, sintering, or other suitable electrically-conductive materials, as with second electrode portion 420, FIGS. 4, 5), or the first and second electrode portions 1410, 1420 may be integrally-formed (e.g., as with second electrode portions 620, 720, FIGS. 6, 7).

The first electrode portion 1410 includes a top (or cavity-facing) surface 1440, and the second electrode portion 1420 includes a top (or cavity-facing) surface 1442. In various embodiments, the topographies of the top surfaces 1440, 1442 of the first and/or second electrode portions 1410, 1420 may be planar or non-planar (e.g., a curved topography, a domed topography, a pyramid shaped topography, a topography with a triangular cross-section, a topography with a sawtooth-shaped cross-section, or an otherwise irregularly shaped topography).

The first and second electrode portions 1410, 1420 may be formed from bulk electrically conductive material (e.g., copper, brass, aluminum, steel, or other electrically-conductive materials). Alternatively, the first and/or second electrode portions 1410, 1420 may include one or more layers of dielectric material and one or more conductive layers (e.g., a conductive layer applied to the surface of the first and/or second electrode portions 1410, 1420, or embedded within the first and/or second electrode portions 1410, 1420) that are configured to radiate electromagnetic energy in a direction substantially perpendicular to the top surfaces 1440, 1442 of the first and second electrode portions 1410, 1420 (e.g., toward a center of a heating cavity (e.g., cavity 260, 360, FIGS. 2, 3)) in response to receiving an RF signal from other portions of a thermal increase system.

The extension portion 1450 may be identical or substantially similar to extension portion 450 (FIG. 4), including the various embodiments of extension portion 450 described above in conjunction with FIG. 4. The extension portion 1450 may be formed from bulk electrically conductive material or from one or more layers of dielectric material and one or more electrical conductors, and the extension portion 1450 is configured to convey an RF signal to the first electrode portion 1410. The extension portion 1450 and the first electrode portion 1410 may be integrally formed together (e.g., from a single sheet of conductive material or a single substrate), or the extension portion 1450 and the first electrode portion 1410 may be separately formed components that are physically and electrically connected together.

When assembled into a thermal increase system (e.g., any of systems 100, 200, 300, FIGS. 1-3), the multi-level electrode 1400 may be nested into a correspondingly shaped dielectric housing (e.g., similar to dielectric housing 800, FIGS. 8 and 9), as previously described.

Figure 15:
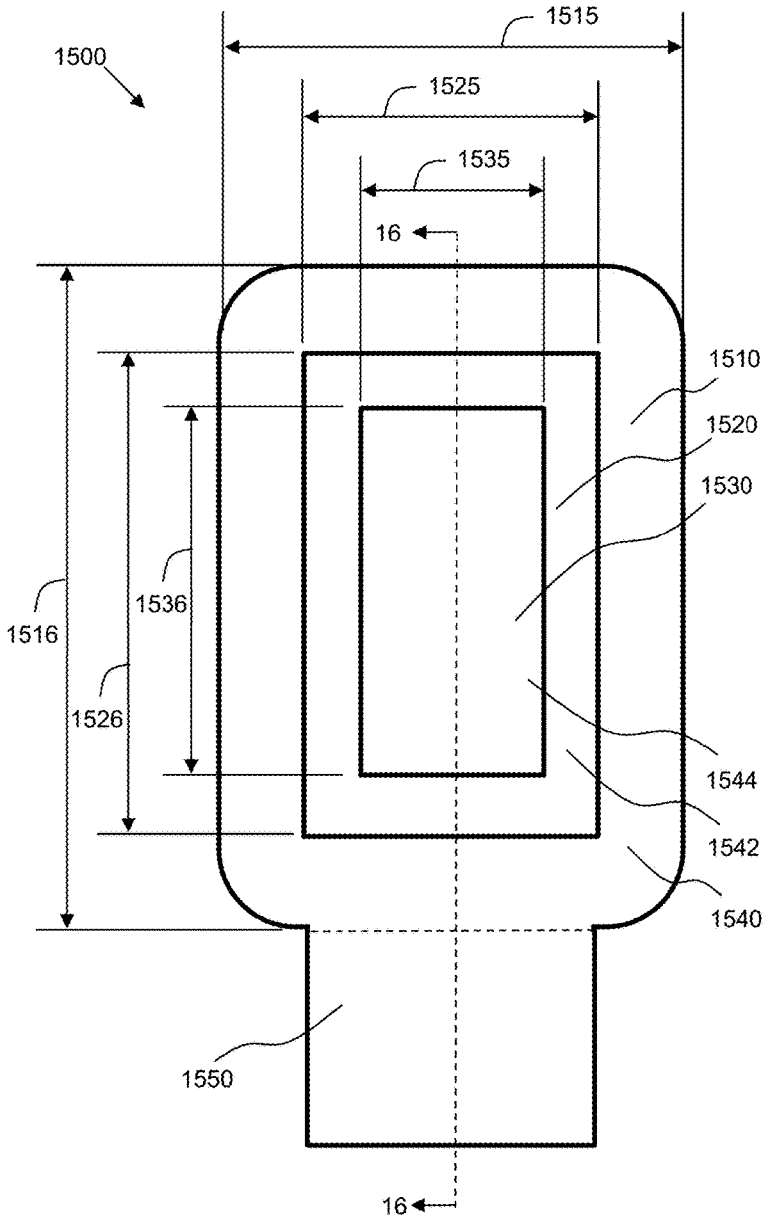
FIGS. 15 and 16 are top and side, cross-sectional views, respectively, of yet another embodiment of a multi-level electrode.
Figure 16:
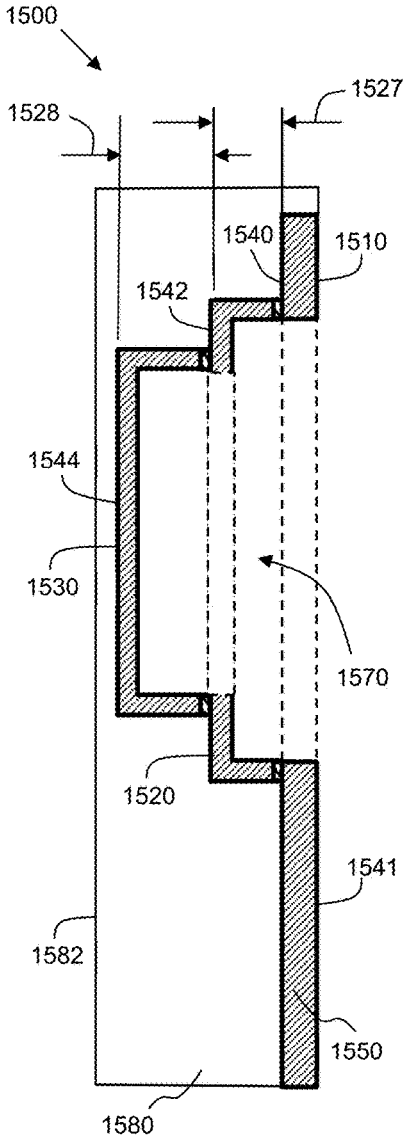

Turning next to FIGS. 15 and 16, top and side, cross-sectional views, respectively, of yet another embodiment of a multi-level electrode 1500 are shown. More specifically, FIG. 15 is a top view of a multi-level electrode 1500, and FIG. 16 is a side, cross-sectional view of the multi-level electrode 1500 along line 16-16 of FIG. 15.

Similar to the previously-described embodiments, multi-level electrode 1500 includes an electromagnetic energy radiating surface (or "cavity-facing" surface) with multiple portions that are not co-planar with each other. More specifically, electrode 1500 includes a first electrode portion 1510 (or "base" portion), a second electrode portion 1520 (or "intermediate elevated" portion), a third electrode portion 1530 (or "highest elevated" portion), and an extension portion 1550. Although the electrode 1500 of FIGS. 15 and 16 indicate that two elevated electrode portions can be stacked upon a base electrode portion, those of skill in the art would understand, based on the description herein, that more than two elevated electrode portions could be stacked upon a base electrode portion. Either way, a bottom surface 1541 of the first electrode portion 1510 defines a bottom surface of the electrode 1500, and a top surface 1544 of the third electrode portion 1530 defines a top surface of the electrode 1500.

Electrode 1500 is similar to electrode 400 (FIGS. 4, 5), and the various embodiments discussed above with respect to that electrode, except that electrode 1500 has more than two non-co-planar radiating surfaces (or more than two electrode portions). More specifically, electrode 400 (FIGS. 4, 5) has two non-co-planar radiating surfaces, which include a first top (or cavity-facing) surface 440 of the first electrode portion 410, and a second top (or cavity-facing) surface 442 of the second electrode portion 420. Similarly, electrode 1500 also has two non-co-planar radiating surfaces, including a first top (or cavity-facing) surface 1540 of a first electrode portion 1510, and a second top (or cavity-facing) surface 1542 of a second electrode portion 1520. However, electrode 1500 also has a third electrode portion 1530 that is positioned over the second electrode portion 1520, where the third electrode portion 1530 has a third top (or cavity-facing) surface 1544 that is not co-planar with surfaces 1540, 1542.

According to an embodiment, a height 1527 of the top surface 1542 of the second electrode portion 1520 above the top surface 1540 of the first electrode portion 1510 is in a range of about 0.5 cm to about 5 cm (e.g., in a range of about 1.0 cm to about 2.0 cm), and a height 1528 of the top surface 1544 of the third electrode portion 1530 above the top surface 1542 of the second electrode portion 1520 is in a range of about 0.5 cm to about 5 cm (e.g., in a range of about 1.0 cm to about 2.0 cm). In other embodiments, either or both of the heights 1527, 1528 may be smaller or larger. The widths 1515, 1525, 1535 and the lengths 1516, 1526, 1536 of the first, second, and third electrode portions 1510, 1520, 1530 each may be in a range of about 5 cm to about 30 cm, in an embodiment. In various embodiments, the width 1515 and/or the length 1516 of the first electrode portion 1510 are in a range of about 20 percent to about 75 percent larger than the width 1525 and/or length 1526 of the second electrode portion 1520, and the width 1525 and/or the length 1526 of the second electrode portion 1520 are in a range of about 20 percent to about 75 percent larger than the width 1535 and/or length 1536 of the third electrode portion 1530. Said another way, the area (including the area of any central opening) or perimeter of the top surface 1540 of the first electrode portion 1510 is significantly larger (e.g., in a range of about 50 percent to about 400 percent larger) than the area or perimeter of the top surface 1542 of the second electrode portion 1520, and the area (including the area of any central opening) or perimeter of the top surface 1542 of the second electrode portion 1520 is significantly larger (e.g., in a range of about 50 percent to about 400 percent larger) than the area or perimeter of the top surface 1544 of the third electrode portion 1530.

In various embodiments, the second and/or third electrode portions 1520, 1530 may be hollow (e.g., similar to second electrode portions 420, 620, FIGS. 4-6), or alternatively either or both electrode portions 1520, 1530 may be in the form of a solid, elevated central conductive island (e.g., similar to second electrode portion 720, FIG. 7). In addition, the second electrode portion 1520 may be attached to the first electrode portion 1510, and the third electrode portion 1530 may be attached to the second electrode portion 1520, in some embodiments (e.g., with solder, conductive adhesive, brazing, sintering, or other suitable electrically-conductive materials, as with second electrode portion 420, FIGS. 4, 5), or the first, second, and third electrode portions 1510, 1520, 1530 may be integrally-formed (e.g., as with second electrode portions 620, 720, FIGS. 6, 7).

The first electrode portion 1510 includes a top (or cavity-facing) surface 1540, the second electrode portion 1520 includes a top (or cavity-facing) surface 1542, and the third electrode portion 1530 includes a top (or cavity-facing) surface 1544. In various embodiments, the topographies of the top surfaces 1540, 1542, 1544 of the first, second, and/or third electrode portions 1510, 1520, 1530 may be planar or non-planar (e.g., a curved topography, a domed topography, a pyramid shaped topography, a topography with a triangular cross-section, a topography with a sawtooth-shaped cross-section, or an otherwise irregularly shaped topography). Further, although the shapes of the top surfaces 1540, 1542, 1544 are shown to be substantially rectangular, the top surfaces 1540, 1542, 1544 may have other shapes, as well (e.g., circular, oval, hexagonal, etc.).

The first, second, and third electrode portions 1510, 1520, 1530 may be formed from bulk electrically conductive material (e.g., copper, brass, aluminum, steel, or other electrically-conductive materials). Alternatively, the first, second, and/or third electrode portions 1510, 1520, 1530 may include one or more layers of dielectric material and one or more conductive layers (e.g., a conductive layer applied to the surface of the first, second, and/or third electrode portions 1510, 1520, 1530 or embedded within the first, second, and/or third electrode portions 1510, 1520, 1530) that are configured to radiate electromagnetic energy in a direction substantially perpendicular to the top surfaces 1540, 1542, 1544 of the first, second, and third electrode portions 1510, 1520, 1530 (e.g., toward a center of a heating cavity (e.g., cavity 260, 360, FIGS. 2, 3)) in response to receiving an RF signal from other portions of a thermal increase system.

The extension portion 1550 may be identical or substantially similar to extension portion 450 (FIG. 4), including the various embodiments of extension portion 450 described above in conjunction with FIG. 4. The extension portion 1550 may be formed from bulk electrically conductive material or from one or more layers of dielectric material and one or more electrical conductors, and the extension portion 1550 is configured to convey an RF signal to the first electrode portion 1510. The extension portion 1550 and the first electrode portion 1510 may be integrally formed together (e.g., from a single sheet of conductive material or a single substrate), or the extension portion 1550 and the first electrode portion 1510 may be separately formed components that are physically and electrically connected together.

When assembled into a thermal increase system (e.g., any of systems 100, 200, 300, FIGS. 1-3), the multi-level electrode 1500 may be nested into a correspondingly shaped dielectric housing 1580 (e.g., similar to dielectric housing 800, FIGS. 8 and 9, except with a differently-shaped cavity), as previously described. In such an embodiment, the outer surface 1582 of the housing 1580 may define the cavity-facing surface of the assembly.

Figure 17:
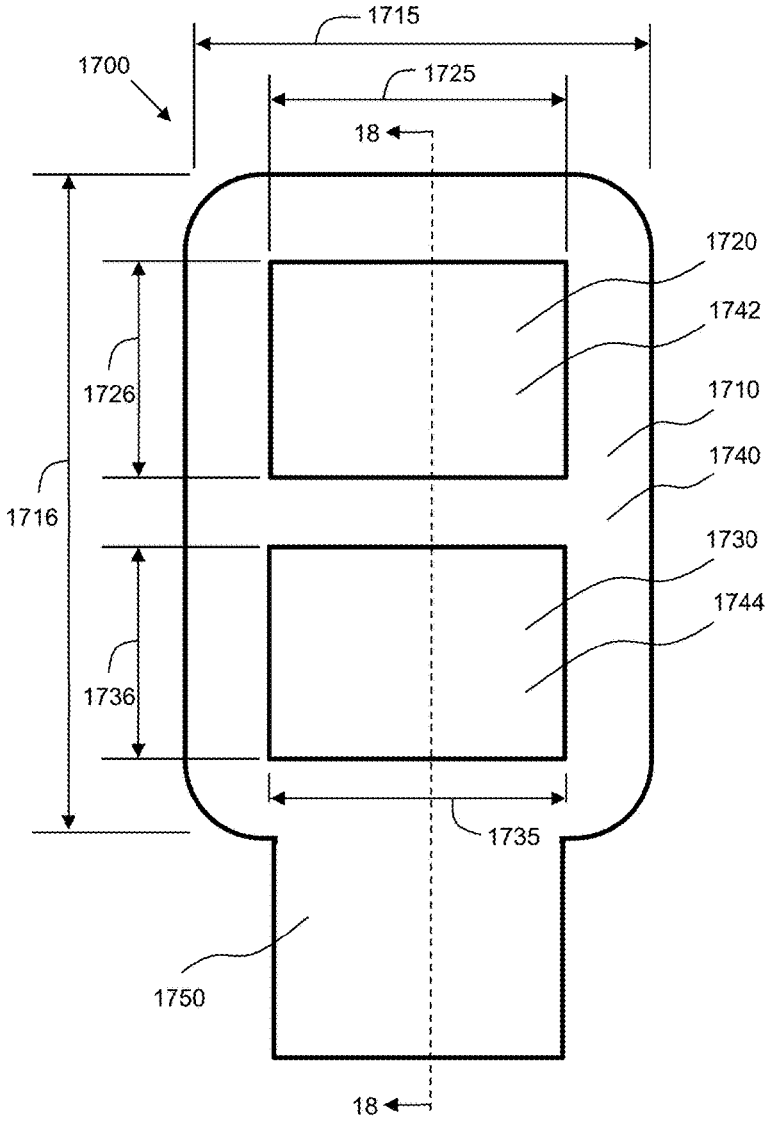
FIGS. 17 and 18 are top and side, cross-sectional views, respectively, of yet another embodiment of a multi-level electrode.
Figure 18:
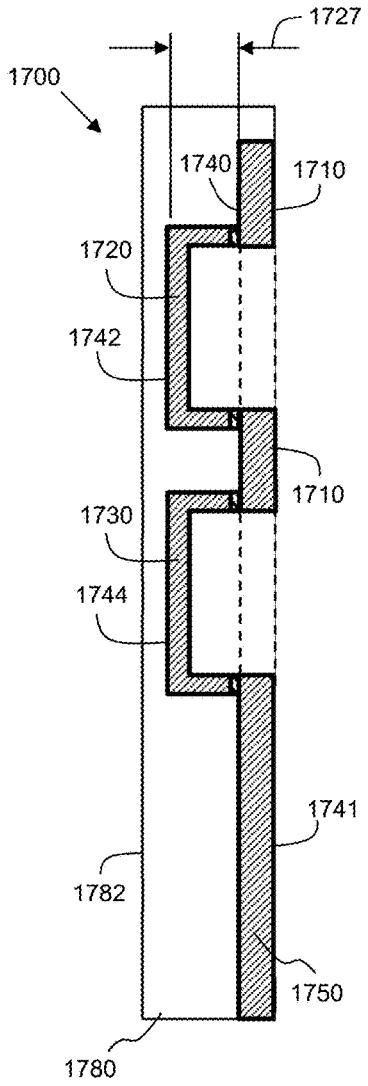

Turning finally to FIGS. 17 and 18, top and side, cross-sectional views, respectively, of yet another embodiment of a multi-level electrode 1700 are shown. More specifically, FIG. 17 is a top view of a multi-level electrode 1700, and FIG. 18 is a side, cross-sectional view of the multi-level electrode 1700 along line 18-18 of FIG. 17.

Similar to the previously-described embodiments, multi-level electrode 1700 includes an electromagnetic energy radiating surface (or "cavity-facing" surface) with multiple portions that are not co-planar with each other. More specifically, electrode 1700 includes a first electrode portion 1710 (or "base" portion), a second electrode portion 1720 (or first elevated" portion), a third electrode portion 1730 (or "second elevated" portion), and an extension portion 1750. Although the electrode 1700 of FIGS. 17 and 18 indicate that two elevated electrode portions can be arranged side-by-side upon a base electrode portion, those of skill in the art would understand, based on the description herein, that more than two elevated electrode portions could be arranged on a base electrode portion. Either way, a bottom surface 1741 of the first electrode portion 1710 defines a bottom surface of the electrode 1700, and top surfaces 1742, 1744 of the second and third electrode portions 1720, 1730 define a top surface of the electrode 1700.

Electrode 1700 is similar to electrode 400 (FIGS. 4, 5), and the various embodiments discussed above with respect to that electrode, except that electrode 1700 has more than two elevated radiating surfaces (or more than two elevated electrode portions). More specifically, electrode 400 (FIGS. 4, 5) has two non-co-planar radiating surfaces, which include a first top (or cavity-facing) surface 440 of the first electrode portion 410, and a second top (or cavity-facing) surface 442 of the second electrode portion 420. Similarly, electrode 1700 also has two non-co-planar radiating surfaces, including a first top (or cavity-facing) surface 1740 of a first electrode portion 1710, and a second top (or cavity-facing) surface 1742 of a second electrode portion 1720. However, electrode 1700 also has a third electrode portion 1730 that is positioned over the first electrode portion 1710 and adjacent to the second electrode portion 1720. The third electrode portion 1730 has a third top (or cavity-facing) surface 1744 that is not co-planar with surface 1740 of the first electrode portion 1710, but that may be co-planar with surface 1742 of the second electrode portion 1720.

According to an embodiment, the height(s) 1727 of the top surfaces 1742, 1744 of the second and third electrode portions 1720, 1730 above the top surface 1740 of the first electrode portion 1710 is in a range of about 0.5 cm to about 5 cm (e.g., in a range of about 1.0 cm to about 2.0 cm). In other embodiments, the height(s) 1727 may be smaller or larger. The widths 1715, 1725, 1735 and the lengths 1716, 1726, 1736 of the first, second, and third electrode portions 1710, 1720, 1730 each may be in a range of about 5 cm to about 30 cm, in an embodiment. In various embodiments, the width 1715 and/or the length 1716 of the first electrode portion 1710 are in a range of about 50 percent to about 100 percent larger than the widths 1725, 1735 and/or lengths 1726, 1736 of the second and third electrode portions 1720, 1730. The widths 1725, 1735 and/or lengths 1726, 1736 of the second and third electrode portions 1720, 1730 may be the same (e.g., the top surfaces 1742, 1744 may have the same area), or the widths 1725, 1735 and/or lengths 1726, 1736 of the second and third electrode portions 1720, 1730 may be different (e.g., the top surfaces 1742, 1744 may have different areas). Said another way, the area (including the area of any central opening) or perimeter of the top surface 1740 of the first electrode portion 1710 is significantly larger (e.g., in a range of about 10 percent to about 800 percent larger) than the area or perimeter of either of the top surfaces 1742, 1744 of the second or third electrode portions 1720, 1730.

In various embodiments, the second and/or third electrode portions 1720, 1730 may be hollow (e.g., similar to second electrode portions 420, 620, FIGS. 4-6), or alternatively either or both electrode portions 1720, 1730 may be in the form of a solid, elevated central conductive island (e.g., similar to second electrode portion 720, FIG. 7). In addition, the second and third electrode portions 1720, 1730 may be attached to the first electrode portion 1710, in some embodiments (e.g., with solder, conductive adhesive, brazing, sintering, or other suitable electrically-conductive materials, as with second electrode portion 420, FIGS. 4, 5), or the first, second, and third electrode portions 1710, 1720, 1730 may be integrally-formed (e.g., as with second electrode portions 620, 720, FIGS. 6, 7).

The first electrode portion 1710 includes a top (or cavity-facing) surface 1740, the second electrode portion 1720 includes a top (or cavity-facing) surface 1742, and the third electrode portion 1730 includes a top (or cavity-facing) surface 1744. In various embodiments, the topographies of the top surfaces 1740, 1742, 1744 of the first, second, and/or third electrode portions 1710, 1720, 1730 may be planar or non-planar (e.g., a curved topography, a domed topography, a pyramid shaped topography, a topography with a triangular cross-section, a topography with a sawtooth-shaped cross-section, or an otherwise irregularly shaped topography). Further, although the shapes of the top surfaces 1740, 1742, 1744 are shown to be substantially rectangular, the top surfaces 1740, 1742, 1744 may have other shapes, as well (e.g., circular, oval, hexagonal, etc.).

The first, second, and third electrode portions 1710, 1720, 1730 may be formed from bulk electrically conductive material (e.g., copper, brass, aluminum, steel, or other electrically-conductive materials). Alternatively, the first, second, and/or third electrode portions 1710, 1720, 1730 may include one or more layers of dielectric material and one or more conductive layers (e.g., a conductive layer applied to the surface of the first, second, and/or third electrode portions 1710, 1720, 1730 or embedded within the first, second, and/or third electrode portions 1710, 1720, 1730) that are configured to radiate electromagnetic energy in a direction substantially perpendicular to the top surfaces 1740, 1742, 1744 of the first, second, and third electrode portions 1710, 1720, 1730 (e.g., toward a center of a heating cavity (e.g., cavity 260, 360, FIGS. 2, 3)) in response to receiving an RF signal from other portions of a thermal increase system.

The extension portion 1750 may be identical or substantially similar to extension portion 450 (FIG. 4), including the various embodiments of extension portion 450 described above in conjunction with FIG. 4. The extension portion 1750 may be formed from bulk electrically conductive material or from one or more layers of dielectric material and one or more electrical conductors, and the extension portion 1750 is configured to convey an RF signal to the first electrode portion 1710. The extension portion 1750 and the first electrode portion 1710 may be integrally formed together (e.g., from a single sheet of conductive material or a single substrate), or the extension portion 1750 and the first electrode portion 1710 may be separately formed components that are physically and electrically connected together.

When assembled into a thermal increase system (e.g., any of systems 100, 200, 300, FIGS. 1-3), the multi-level electrode 1700 may be nested into a correspondingly shaped dielectric housing 1780 (e.g., similar to dielectric housing 800, FIGS. 8 and 9, except with a differently-shaped cavities), as previously described. In such an embodiment, the outer surface 1782 of the housing 1780 may define the cavity-facing surface of the assembly.

Embodiments of the present invention include multi-level electrode(s), which facilitate provision of a more evenly-distributed electromagnetic field (or a more uniform field distribution) in a cavity of a thermal increase system (e.g., cavity 260, 360, FIGS. 2, 3). This may in turn result in more even warming of a load within the cavity.

Figure 19:
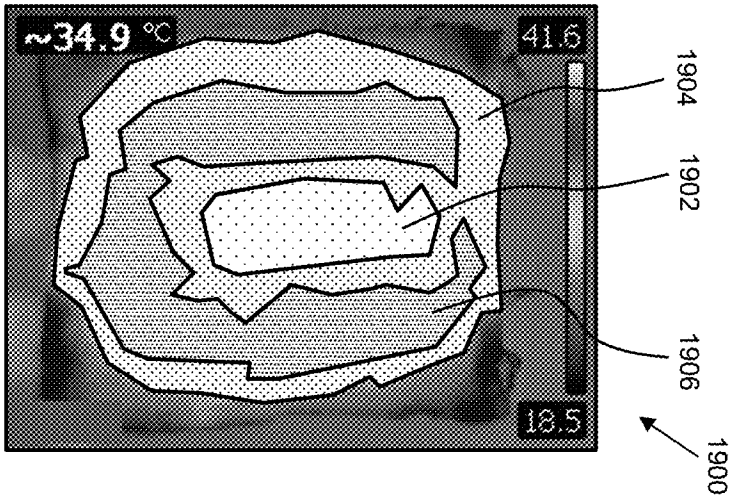
FIGS. 19 and 20 are electromagnetic field plots across a parallel plane within a cavity in which a conventional planar electrode produces the field, and within a cavity in which an embodiment of a multi-level electrode produces the field, respectively.
Figure 20:
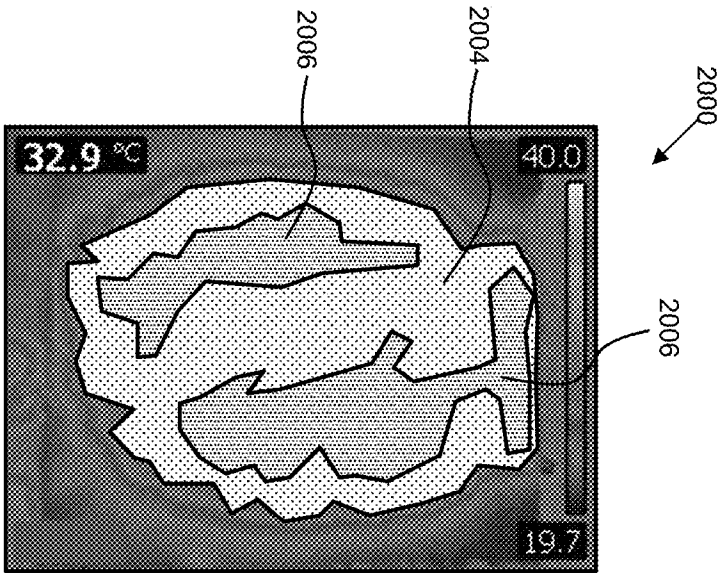

To better illustrate this phenomenon, FIGS. 19 and 20 are electromagnetic field plots 1900, 2000 across a measurement plane within a cavity (i.e., a plane parallel to the top surface of an electrode). More specifically, plot 1900 corresponds to a plot of an electromagnetic field produced by a conventional planar electrode, and plot 2000 corresponds to a plot of an electromagnetic field produced by an embodiment of a multi-level electrode (e.g., one of electrodes 240, 240', 340, 350, 400, 600, 700, 1300, 1400, 1500, 1700, FIGS. 2-17). In plot 1900, the electromagnetic field intensity varies from a relatively-low intensity region 1902 roughly in the center of the field measurement plane, through an intermediate intensity region 1904, to a relatively-high intensity region 1906 in a more peripheral portion of the measurement plane. In contrast, in plot 2000, the electromagnetic field intensity is more evenly distributed between an intermediate intensity region 2004 and relatively-high intensity regions 2006. Comparison of plots 1900 and 2000 shows that the electromagnetic field intensity variation across a cavity may be significantly decreased in a system in which an embodiment of a multi-level electrode is used, when compared with the electromagnetic field intensity variation in a system in which a conventional planar electrode is used.

Figure 21:
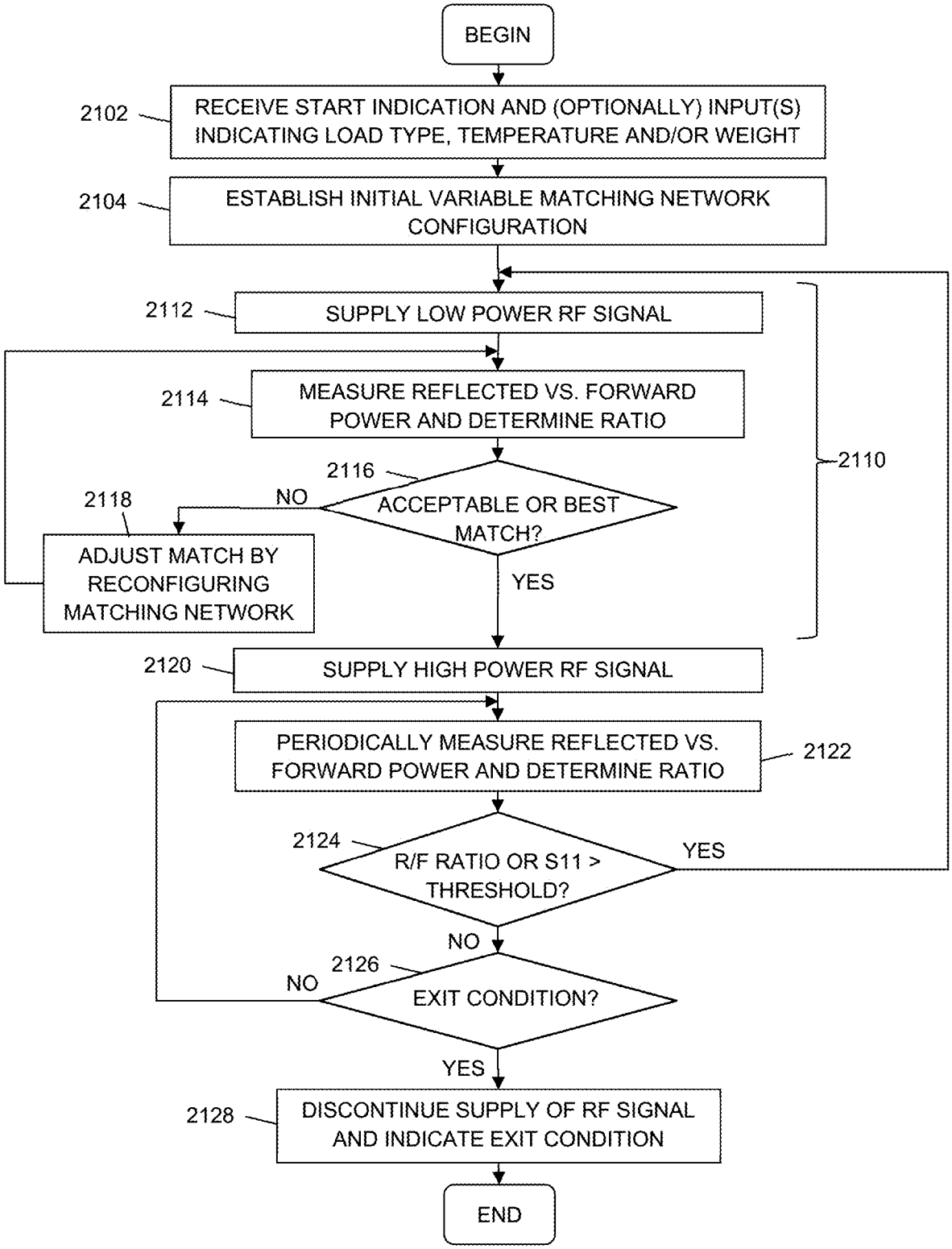
FIG. 21 is a flowchart of a method of operating a thermal increase system with multi-level electrode(s), in accordance with an example embodiment.

Now that embodiments of the electrical and physical aspects of multi-level electrodes within thermal increase systems have been described, various embodiments of methods for operating such thermal increase systems will now be described in conjunction with FIG. 21. More specifically, FIG. 21 is a flowchart of a method of operating a thermal increase system (e.g., system 100, 200, 300, FIGS. 1-3) with multi-level electrodes, in accordance with an example embodiment.

The method may begin, in block 2102, when the system controller (e.g., system controller 212, 313, FIGS. 2, 3) receives an indication that a defrosting or heating operation should start. Such an indication may be received, for example, after a user has place a load (e.g., load 264, 364, FIGS. 2, 3) into the system's cavity (e.g., cavity 260, 360, FIGS. 2, 3), has sealed the cavity (e.g., by closing a door or drawer), and has pressed a start button (e.g., of the user interface 280, 380, FIGS. 2, 3). In an embodiment, sealing of the cavity may engage one or more safety interlock mechanisms, which when engaged, indicate that RF power supplied to the cavity will not substantially leak into the environment outside of the cavity. As will be described later, disengagement of a safety interlock mechanism may cause the system controller immediately to pause or terminate the defrosting or heating operation.

According to various embodiments, the system controller optionally may receive additional inputs indicating the load type (e.g., meats, liquids, or other materials), the initial load temperature, and/or the load weight. For example, information regarding the load type may be received from the user through interaction with the user interface (e.g., by the user selecting from a list of recognized load types). Alternatively, the system may be configured to scan a barcode visible on the exterior of the load, or to receive an electronic signal from an RFID device on or embedded within the load. Information regarding the initial load temperature may be received, for example, from one or more temperature sensors and/or IR sensors (e.g., sensors 290, 390, FIGS. 2, 3) of the system. Information regarding the load weight may be received from the user through interaction with the user interface, or from a weight sensor (e.g., sensor 290, 390, FIGS. 2, 3) of the system. As indicated above, receipt of inputs indicating the load type, initial load temperature, and/or load weight is optional, and the system alternatively may not receive some or all of these inputs.

In block 2104, the system controller provides control signals to the variable matching network (e.g., network 270, 372, FIGS. 2, 3) to establish an initial configuration or state for the variable matching network. As described previously, the control signals affect the values of various component values (e.g., inductances and/or capacitances) within the variable matching network. Desirably, the control signals are provided to configure the variable matching network to provide an optimum match between the RF signal source and the cavity plus load.

Once the initial variable matching network configuration is established, the system controller may perform a process 2110 of adjusting, if necessary, the configuration of the variable impedance matching network to find an acceptable or best match based on actual measurements that are indicative of the quality of the match. According to an embodiment, this process includes causing the RF signal source (e.g., RF signal source 220, 320, 320', FIGS. 2, 3) to supply a relatively low power RF signal through the variable impedance matching network to the multi-level electrode(s) (e.g., first electrode 240, 240' or both electrodes 340, 350, FIGS. 2, 3), in block 2112. The system controller may control the RF signal power level through control signals to the power supply and bias circuitry (e.g., circuitry 226, 326, FIGS. 2, 3), where the control signals cause the power supply and bias circuitry to provide supply and bias voltages to the amplifiers (e.g., amplifier stages 224, 225, 324, 324', FIGS. 2, 3) that are consistent with the desired signal power level. For example, the relatively low power RF signal may be a signal having a power level in a range of about 10 W to about 20 W, although different power levels alternatively may be used. A relatively low power level signal during the match adjustment process 2110 is desirable to reduce the risk of damaging the cavity or load (e.g., if the initial match causes high reflected power), and to reduce the risk of damaging the switching components of the variable inductance networks (e.g., due to arcing across the switch contacts).

In block 2114, power detection circuitry (e.g., power detection circuitry 230, 330, 330', 330", FIGS. 2, 3) then measures the reflected and (in some embodiments) forward power along the transmission path (e.g., path 228, 328, FIGS. 2, 3) between the RF signal source and the electrode(s), and provides those measurements to the system controller. The system controller may then determine a ratio between the reflected and forward signal powers, and may determine the S11 parameter for the system based on the ratio. The system controller may store the received power measurements (e.g., the received reflected power measurements, the received forward power measurement, or both), and/or the calculated ratios, and/or S11 parameters for future evaluation or comparison, in an embodiment.

In block 2116, the system controller may determine, based on the reflected power measurements, and/or the reflected-to-forward signal power ratio, and/or the S11 parameter, whether or not the match provided by the variable impedance matching network is acceptable (e.g., the reflected power is below a threshold, or the ratio is 10 percent or less, or the measurements or values compare favorably with some other criteria). Alternatively, the system controller may be configured to determine whether the match is the "best" match. A "best" match may be determined, for example, by iteratively measuring the reflected RF power (and in some embodiments the forward reflected RF power) for all possible impedance matching network configurations (or at least for a defined subset of impedance matching network configurations), and determining which configuration results in the lowest reflected RF power and/or the lowest reflected-to-forward power ratio.

When the system controller determines that the match is not acceptable or is not the best match, the system controller may adjust the match, in block 2118, by reconfiguring the variable impedance matching network. For example, this may be achieved by sending control signals to the variable impedance matching network, which cause the network to increase and/or decrease the values of variable components within the network (e.g., by causing variable inductance networks and/or variable capacitance networks to have different inductance or capacitance states or values). After reconfiguring the variable impedance network, blocks 2114, 2116, and 2118 may be iteratively performed until an acceptable or best match is determined in block 2116.

Once an acceptable or best match is determined, the defrosting or heating operation may commence. Commencement of the defrosting or heating operation includes increasing the power of the RF signal supplied by the RF signal source (e.g., RF signal source 220, 320, 320', FIGS. 2, 3) to a relatively high-power RF signal, in block 2120. Once again, the system controller may control the RF signal power level through control signals to the power supply and bias circuitry, where the control signals cause the power supply and bias circuitry to provide supply and bias voltages to the amplifiers (e.g., amplifier stages 224, 225, 324, 324', FIGS. 2, 3) that are consistent with the desired signal power level. For example, the relatively high power RF signal may be a signal having a power level in a range of about 50 W to about 500 W, although different power levels alternatively may be used.

In block 2122, power detection circuitry (e.g., power detection circuitry 230, 330, 330', 330", FIGS. 2, 3) then periodically measures the reflected power and, in some embodiments, the forward power along the transmission path (e.g., path 228, 328, FIGS. 2, 3) between the RF signal source and the electrode(s), and provides those measurements to the system controller. The system controller again may determine a ratio between the reflected and forward signal powers, and may determine the S11 parameter for the system based on the ratio. The system controller may store the received power measurements, and/or the calculated ratios, and/or S11 parameters for future evaluation or comparison, in an embodiment. According to an embodiment, the periodic measurements of the forward and reflected power may be taken at a fairly high frequency (e.g., on the order of milliseconds) or at a fairly low frequency (e.g., on the order of seconds). For example, a fairly low frequency for taking the periodic measurements may be a rate of one measurement every 10 seconds to 20 seconds.

In block 2124, the system controller may determine, based on one or more reflected signal power measurements, one or more calculated reflected-to-forward signal power ratios, and/or one or more calculated S11 parameters, whether or not the match provided by the variable impedance matching network is acceptable. For example, the system controller may use a single reflected signal power measurement, a single calculated reflected-to-forward signal power ratio, or a single calculated S11 parameter in making this determination, or may take an average (or other calculation) of a number of previously-received reflected signal power measurements, previously-calculated reflected-to-forward power ratios, or previously-calculated S11 parameters in making this determination. To determine whether or not the match is acceptable, the system controller may compare the received reflected signal power, the calculated ratio, and/or S11 parameter to one or more corresponding thresholds, for example. For example, in one embodiment, the system controller may compare the received reflected signal power to a threshold of, for example, 5 percent (or some other value) of the forward signal power. A reflected signal power below 5 percent of the forward signal power may indicate that the match remains acceptable, and a ratio above 5 percent may indicate that the match is no longer acceptable. In another embodiment, the system controller may compare the calculated reflected-to-forward signal power ratio to a threshold of 10 percent (or some other value). A ratio below 10 percent may indicate that the match remains acceptable, and a ratio above 10 percent may indicate that the match is no longer acceptable. When the measured reflected power, or the calculated ratio or S11 parameter is greater than the corresponding threshold (i.e., the comparison is unfavorable), indicating an unacceptable match, then the system controller may initiate re-configuration of the variable impedance matching network by again performing process 2110.

In block 2124, when the system controller determines, based on one or more reflected power measurements, one or more calculated reflected-to-forward signal power ratios, and/or one or more calculated S11 parameters, that the match provided by the variable impedance matching network is still acceptable (e.g., the reflected power measurements, calculated ratio, or S11 parameter is less than a corresponding threshold, or the comparison is favorable), the system may evaluate whether or not an exit condition has occurred, in block 2126. In actuality, determination of whether an exit condition has occurred may be an interrupt driven process that may occur at any point during the defrosting process. However, for the purposes of including it in the flowchart of FIG. 21, the process is shown to occur after block 2124.

In any event, several conditions may warrant cessation of the defrosting or heating operation. For example, the system may determine that an exit condition has occurred when a safety interlock is breached. Alternatively, the system may determine that an exit condition has occurred upon expiration of a timer that was set by the user (e.g., through user interface 280, 380, FIGS. 2, 3) or upon expiration of a timer that was established by the system controller based on the system controller's estimate of how long the defrosting or heating operation should be performed. In still another alternate embodiment, the system may otherwise detect completion of the defrosting or heating operation.

If an exit condition has not occurred, then the defrosting or heating operation may continue by iteratively performing blocks 2122 and 2124 (and the matching network reconfiguration process 2110, as necessary). When an exit condition has occurred, then in block 2128, the system controller causes the supply of the RF signal by the RF signal source to be discontinued. For example, the system controller may disable the RF signal generator (e.g., RF signal generator 222, 322, FIGS. 2, 3) and/or may cause the power supply and bias circuitry (e.g., circuitry 226, 326, FIGS. 2, 3) to discontinue provision of the supply current. In addition, the system controller may send signals to the user interface (e.g., user interface 280, 380, FIGS. 2, 3) that cause the user interface to produce a user-perceptible indicia of the exit condition (e.g., by displaying "door open" or "done" on a display device, or providing an audible tone). The method may then end.

It should be understood that the order of operations associated with the blocks depicted in FIG. 21 corresponds to an example embodiment, and should not be construed to limit the sequence of operations only to the illustrated order. Instead, some operations may be performed in different orders, and/or some operations may be performed in parallel.

The connecting lines shown in the various figures contained herein are intended to represent exemplary functional relationships and/or physical couplings between the various elements. It should be noted that many alternative or additional functional relationships or physical connections may be present in an embodiment of the subject matter. In addition, certain terminology may also be used herein for the purpose of reference only, and thus are not intended to be limiting, and the terms "first", "second" and other such numerical terms referring to structures do not imply a sequence or order unless clearly indicated by the context.

As used herein, a "node" means any internal or external reference point, connection point, junction, signal line, conductive element, or the like, at which a given signal, logic level, voltage, data pattern, current, or quantity is present. Furthermore, two or more nodes may be realized by one physical element (and two or more signals can be multiplexed, modulated, or otherwise distinguished even though received or output at a common node).

The foregoing description refers to elements or nodes or features being "connected" or "coupled" together. As used herein, unless expressly stated otherwise, "connected" means that one element is directly joined to (or directly communicates with) another element, and not necessarily mechanically. Likewise, unless expressly stated otherwise, "coupled" means that one element is directly or indirectly joined to (or directly or indirectly communicates with) another element, and not necessarily mechanically. Thus, although the schematic shown in the figures depict one exemplary arrangement of elements, additional intervening elements, devices, features, or components may be present in an embodiment of the depicted subject matter.

An embodiment of a thermal increase system, which is coupled to a cavity for containing a load, includes one or more multi-level electrodes configured to radiate electromagnetic energy into the cavity in response to receiving an RF signal from an RF signal source. Each multi-level electrode is positioned adjacent to a wall of the cavity, and each multi-level electrode includes a base portion coupled to an elevated portion. A radiating surface of the elevated portion is at a height of at least 0.5 cm from a radiating surface of the base portion. In some embodiments, the radiating surface of the elevated portion is in a range of about 1.0 cm to about 2.0 cm from the radiating surface of the base portion.

An embodiment of an electrode assembly includes a multi-level electrode and a dielectric support. The multi-level electrode is configured to radiate electromagnetic energy, and the multi-level electrode includes a base portion coupled to a first elevated portion. A radiating surface of the first elevated portion is at a height of at least 0.5 cm from a radiating surface of the base portion. The dielectric support has a planar outer surface and a cavity in an opposite surface from the outer surface, where the cavity is shaped to receive the multi-level electrode.

While at least one exemplary embodiment has been presented in the foregoing detailed description, it should be appreciated that a vast number of variations exist. It should also be appreciated that the exemplary embodiment or embodiments described herein are not intended to limit the scope, applicability, or configuration of the claimed subject matter in any way. Rather, the foregoing detailed description will provide those skilled in the art with a convenient road map for implementing the described embodiment or embodiments. It should be understood that various changes can be made in the function and arrangement of elements without departing from the scope defined by the claims, which includes known equivalents and foreseeable equivalents at the time of filing this patent application.

What is claimed is:

1. A thermal increase system coupled to a cavity for containing a load, the thermal increase system comprising:

a first multi-level electrode configured to radiate electromagnetic energy into the cavity in response to receiving a radio frequency (RF) signal from an RF signal source, wherein the first multi-level electrode is positioned adjacent to a first wall of the cavity, and the first multi-level electrode includes a first base portion coupled to a first elevated portion, wherein a radiating surface of the first elevated portion is at a height of at least 0.5 centimeters (cm) from a radiating surface of the first base portion.

2. The thermal increase system of claim 1, wherein:

the radiating surface of the first base portion is a planar top surface of the first base portion; and the radiating surface of the first elevated portion is a planar top surface of the first elevated portion.

3. The thermal increase system of claim 1, wherein a topography of a top surface of the first elevated portion is selected from a planar topography, a curved topography, a domed topography, a pyramid shaped topography, a topography with a triangular cross-section, a topography with a sawtooth-shaped cross-section, and an irregularly shaped topography.

4. The thermal increase system of claim 1, wherein the first elevated portion is coupled to a top surface of the first base portion, and the first multi-level electrode further comprises:

a second elevated portion coupled to a top surface of the first elevated portion.

5. The thermal increase system of claim 1, wherein the first multi-level electrode further comprises:

a second elevated portion coupled to a top surface of the first base portion.

6. The thermal increase system of claim 1, wherein the first multi-level electrode further comprises:

an extension portion, wherein the extension portion has a first end coupled to the first base portion, and a second end that is configured to be electrically connected to the RF signal source.

7. The thermal increase system of claim 6, wherein the first multi-level electrode includes a central cavity in a bottom surface of the first multi-level electrode.

8. The thermal increase system of claim 1, wherein the first multi-level electrode is formed from bulk electrically conductive material selected from copper, brass, aluminum, and steel.

9. The thermal increase system of claim 1, wherein the first elevated portion is attached to a top surface of the first base portion.

10. The thermal increase system of claim 1, wherein the first base portion and the first elevated portion are integrally formed together.

11. The thermal increase system of claim 1, wherein the first elevated portion is a solid conductive island.

12. The thermal increase system of claim 1, wherein the radiating surface of the first elevated portion is in a range of 1.0 cm to 2.0 cm from the radiating surface of the first base portion.

13. The thermal increase system of claim 1, further comprising:

a dielectric support with a planar outer surface and a cavity in an opposite surface from the outer surface, wherein the cavity is shaped to receive the first multi-level electrode.

14. The thermal increase system of claim 1, wherein the first wall is selected from a top wall of the cavity, a bottom wall of the cavity, and a side wall of the cavity.

15. The thermal increase system of claim 1, further comprising:

a second multi-level electrode configured to radiate the electromagnetic energy into the cavity in response to receiving a second RF signal from the RF signal source, wherein the second multi-level electrode is positioned adjacent to a second wall at an opposite side of the cavity from the first wall, wherein the second multi-level electrode includes a second base portion coupled to a second elevated portion, and wherein a radiating surface of the second elevated portion is at a height of at least 0.5 cm from a radiating surface of the second base portion.

16. The thermal increase system of claim 1, further comprising:

the RF signal source, which is configured to supply the RF signal; and an impedance matching network electrically coupled between the RF signal source and the first multi-level electrode, wherein the impedance matching network comprises a network of variable passive components.

17. An electrode assembly comprising:

a multi-level electrode configured to radiate electromagnetic energy, wherein the multi-level electrode includes a base portion coupled to a first elevated portion, wherein a radiating surface of the first elevated portion is at a height of at least 0.5 centimeters (cm) from a radiating surface of the base portion; and a dielectric support with a planar outer surface and a cavity in an opposite surface from the outer surface, wherein the cavity is shaped to receive the multi-level electrode.

18. The electrode assembly of claim 17, wherein the multi-level electrode further comprises:

a second elevated portion coupled to a top surface of the first elevated portion.

19. The electrode assembly of claim 17, wherein the multi-level electrode further comprises:

a second elevated portion coupled to a top surface of the base portion.

20. The electrode assembly of claim 17, wherein the radiating surface of the first elevated portion is in a range of 1.0 cm to 2.0 cm from the radiating surface of the base portion.

* * * * *